US008558772B2

(12) United States Patent
Yamagishi et al.

(10) Patent No.: US 8,558,772 B2
(45) Date of Patent: Oct. 15, 2013

(54) IMAGE DISPLAY APPARATUS

(75) Inventors: Nobuhiko Yamagishi, Tokyo (JP); Yoshitomo Nakamura, Tokyo (JP); Hironobu Yasui, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 1613 days.

(21) Appl. No.: 11/822,967

(22) Filed: Jul. 11, 2007

(65) Prior Publication Data

US 2008/0030450 A1 Feb. 7, 2008

(30) Foreign Application Priority Data

Aug. 2, 2006 (JP) ..... 2006-210689
Nov. 27, 2006 (JP) ..... 2006-318137
Dec. 27, 2006 (JP) ..... 2006-351023

(51) Int. Cl.
*G09G 3/36* (2006.01)

(52) U.S. Cl.
USPC ..... 345/89; 382/168

(58) Field of Classification Search
None
See application file for complete search history.

(56) References Cited

U.S. PATENT DOCUMENTS 7,167,214 B2 1/2007 Hirosue
2005/0219179 A1* 10/2005 Kim ..... 345/89

FOREIGN PATENT DOCUMENTS

| | | | |
|---|---|---|---|
| JP | 10-322622 | A | 12/1998 |
| JP | 2000-134525 | A | 5/2000 |
| JP | 2002-520747 | A | 7/2002 |
| JP | 2003-345315 | A | 12/2003 |
| JP | 2004-7301 | A | 1/2004 |
| JP | 2004-45634 | A | 2/2004 |
| JP | 2005-321423 | A | 11/2005 |
| JP | 2006-173856 | A | 6/2006 |
| JP | 2006-311166 | A | 11/2006 |
| WO | WO-00/04498 | A1 | 1/2000 |

* cited by examiner

*Primary Examiner* — Jason Olson
(74) *Attorney, Agent, or Firm* — Birch, Stewart, Kolasch & Birch, LLP

(57) ABSTRACT

An image processing apparatus is obtained which is capable of performing gray-level correction while maintaining real-time property and accurately recognizing the feature of content obtained from an image signal. A luminance information detecting block detects a luminance information value about individual pixels from a luminance signal contained in an image signal. On the basis of the luminance information value, a content feature detecting block determines the feature of one frame of the video content, and obtains a content feature judge information value. On the basis of the content feature judge information value, a multiple content feature detecting block detects the feature of multiple frames of the video content, and outputs a multiple content feature judge information value to an image quality adjustment control block in an image quality adjusting block. On the basis of the multiple content feature information, the image quality adjustment control block calculates a correction parameter that is used when an image quality adjustment carrying-out block applies gray-level correction etc. to the image signal, and outputs the correction parameter to the image quality adjustment carrying-out block.

20 Claims, 25 Drawing Sheets

F I G . 8

105y

| | Yi-ave | Yi-min | Yi-mid | Yi-max | Ji |
|---|---|---|---|---|---|
| 1 | SMALL | SMALL | SMALL | SMALL | J1 |
| 2 | SMALL | SMALL | SMALL | MIDDLE | J2 |
| 3 | SMALL | SMALL | SMALL | LARGE | J3 |
| 4 | SMALL | SMALL | MIDDLE | SMALL | J4 |
| 5 | SMALL | SMALL | MIDDLE | MIDDLE | J5 |
| 6 | SMALL | SMALL | MIDDLE | LARGE | J6 |
| 7 | SMALL | SMALL | LARGE | SMALL | J7 |
| 8 | SMALL | SMALL | LARGE | MIDDLE | J8 |
| | | | | | |
| | | | | | |
| 72 | LARGE | MIDDLE | LARGE | LARGE | J72 |
| 73 | LARGE | LARGE | SMALL | SMALL | J73 |
| 74 | LARGE | LARGE | SMALL | MIDDLE | J74 |
| 75 | LARGE | LARGE | SMALL | LARGE | J75 |
| 76 | LARGE | LARGE | MIDDLE | SMALL | J76 |
| 77 | LARGE | LARGE | MIDDLE | MIDDLE | J77 |
| 78 | LARGE | LARGE | MIDDLE | LARGE | J78 |
| 79 | LARGE | LARGE | LARGE | SMALL | J79 |
| 80 | LARGE | LARGE | LARGE | MIDDLE | J80 |
| 81 | LARGE | LARGE | LARGE | LARGE | J81 |

F I G . 2 1

205y

| | Yi-ave | Ni-min | Ni-mid | Ni-max | Ji |
|---|---|---|---|---|---|
| 1 | SMALL | SMALL | SMALL | SMALL | J1 |
| 2 | SMALL | SMALL | SMALL | MIDDLE | J2 |
| 3 | SMALL | SMALL | SMALL | LARGE | J3 |
| 4 | SMALL | SMALL | MIDDLE | SMALL | J4 |
| 5 | SMALL | SMALL | MIDDLE | MIDDLE | J5 |
| 6 | SMALL | SMALL | MIDDLE | LARGE | J6 |
| 7 | SMALL | SMALL | LARGE | SMALL | J7 |
| 8 | SMALL | SMALL | LARGE | MIDDLE | J8 |
| | | | | | |
| | | | | | |
| 72 | LARGE | MIDDLE | LARGE | LARGE | J72 |
| 73 | LARGE | LARGE | SMALL | SMALL | J73 |
| 74 | LARGE | LARGE | SMALL | MIDDLE | J74 |
| 75 | LARGE | LARGE | SMALL | LARGE | J75 |
| 76 | LARGE | LARGE | MIDDLE | SMALL | J76 |
| 77 | LARGE | LARGE | MIDDLE | MIDDLE | J77 |
| 78 | LARGE | LARGE | MIDDLE | LARGE | J78 |
| 79 | LARGE | LARGE | LARGE | SMALL | J79 |
| 80 | LARGE | LARGE | LARGE | MIDDLE | J80 |
| 81 | LARGE | LARGE | LARGE | LARGE | J81 |

FIG. 23

| CONTROL VALUE | MULTIPLE CONTENT FEATURE JUDGE VALUE Fi | F1: SPORTS | F2: MUSIC | F3: STUDIO | F4: MOVIE | F5: DRAMA/ ANIMATION |
|---|---|---|---|---|---|---|
| Pi | CONTRAST | MEDIUM | HIGH | LOW | HIGH | HIGH |
| | SHARPNESS | LOW | MEDIUM | HIGH | LOW | MEDIUM |
| | COLOR DENSITY | MEDIUM | HIGH | MEDIUM | LOW | HIGH |
| | 3D NOISE REDUCTION | LOW | MEDIUM | HIGH | LOW | MEDIUM |
| | GAMMA CORRECTION | 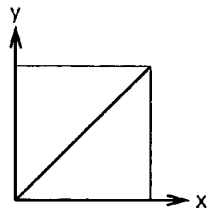 | 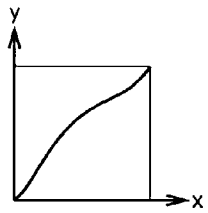 | 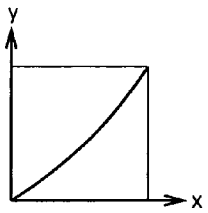 | 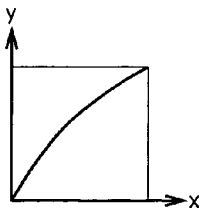 | 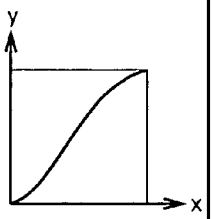 |
| Ci | OVERDRIVE | HIGH | HIGH | MEDIUM | MEDIUM | LOW |
| | BACKLIGHT | MEDIUM | HIGH | MEDIUM | LOW | MEDIUM |

F I G . 2 5

| | Yi-ave | Yi-min | Yi-mid | Yi-max |
|---|---|---|---|---|
| 1 | SMALL | SMALL | SMALL | SMALL |
| 2 | SMALL | SMALL | SMALL | MIDDLE |
| 3 | SMALL | SMALL | SMALL | LARGE |
| 4 | SMALL | SMALL | MIDDLE | SMALL |
| 5 | SMALL | SMALL | MIDDLE | MIDDLE |
| 6 | SMALL | SMALL | MIDDLE | LARGE |
| 7 | SMALL | SMALL | LARGE | SMALL |
| 8 | SMALL | SMALL | LARGE | MIDDLE |
| | | | | |
| | | | | |
| 74 | LARGE | LARGE | SMALL | MIDDLE |
| 75 | LARGE | LARGE | SMALL | LARGE |
| 76 | LARGE | LARGE | MIDDLE | SMALL |
| 77 | LARGE | LARGE | MIDDLE | MIDDLE |
| 78 | LARGE | LARGE | MIDDLE | LARGE |
| 79 | LARGE | LARGE | LARGE | SMALL |
| 80 | LARGE | LARGE | LARGE | MIDDLE |
| 81 | LARGE | LARGE | LARGE | LARGE |

IMAGE DISPLAY APPARATUS

BACKGROUND OF THE INVENTION

1. Field of the Invention

The present invention relates to an image display apparatus.

2. Description of the Background Art

A conventional image display apparatus is disclosed in Japanese Patent Application Laid-Open No. 10-322622 (1998), for example (which is hereinafter referred to as Patent Document 1). In the digital television receiver described in Patent Document 1, output video characteristics and output audio characteristics are set according to the genre and the tastes of a user, on the basis of genre information transmitted together with the digital broadcast content from the broadcast station.

Also, a method for characterizing video content is disclosed in Japanese Patent Application Laid-Open No. 2002-520747 (which is hereinafter referred to as Patent Document 2), for example. The histogram method of Patent Document 2 for characterizing video content identifies key frames from the video content, generates histograms from the key frames, and categorizes the histograms to find program boundaries and to search for video content.

Also, an image processing apparatus described in Japanese Patent Application Laid-Open No. 2004-7301 (which is hereinafter referred to as Patent Document 3) achieves improved image quality by obtaining a relation between luminance signal of the input video signal and frequencies of appearance, from a cumulative histogram about the luminance signal, selecting a gray-level pattern suitable for the video, and correcting the video signal on the basis of the selected gray-level pattern.

In patent Document 1, the genre information is transmitted together with the content information in digital broadcasting such as CS broadcasting. That is, the content information is not contained in conventional analog broadcasting and recorded videos such as DVDs and the like. Also, the transmitted video genre information is not always classified in the same categories of genres as those classified by the viewer. For example, whether the content is an animation or a movie is determined according to the information transmitted from the broadcast station, and the genre may differ from the categorization by the viewer.

In Patent Document 2, it is impossible to judge the genre of video in a real-time manner, because the genre is judged by identifying key frames, generating histograms, and grouping the histograms, so as to search for program boundaries and programs.

Thus, the amount of characterization of video is extracted from luminance histograms about the input video signal, and image processing is performed in correspondence with the characterization of the content, but the image processing might work undesirably because the amount of characterization obtained from one frame of image signal is not stable even in the same genre.

In Patent Document 3, the gray levels of video signal are corrected on the basis of a gray-level correction curve determined from a cumulative luminance histogram, but the characterization and genre of the content are not determined. Also, the gray-level correction pattern may be changed in a frame where a scene change is not detected, in which case a weighted mean of the gray-level correction curves of the present and previous frames is obtained, but the change of image quality may be undesirably noticeable.

SUMMARY OF THE INVENTION

An object of the present invention is to provide an image display apparatus that judges a feature and/or genre of content and automatically performs image quality correction suitable for the feature and/or genre of the content in such a manner that the change of image quality is unnoticeable.

An image display apparatus according to the present invention includes a luminance information detecting block, a feature judging block, a multiple feature judging block, and a video correcting block.

The luminance information detecting block generates a histogram by using a luminance signal obtained from one frame or multiple frames of an image signal, and outputs a luminance-related information value from the histogram. The feature judging block determines a feature of video content of the one frame or multiple frames of the image signal on the basis of the luminance-related information value outputted from the luminance information detecting block to output a feature judge value. The multiple feature judging block analyzes the feature judge value outputted from the feature judging block over multiple frames to obtain a multiple feature judge value. The video correcting block applies video correction to one frame of the image signal, on the basis of the multiple feature judge value.

The image display apparatus analyzes the feature judge value over multiple frames, and judges the feature of the content on the basis of the amounts of feature about the multiple frames, whereby the characteristic of the content can be judged more accurately.

Also, the video correcting block applies video correction to the image signal on the basis of the judgment, whereby contrast, for example, can be adjusted according to the characteristic, and enhanced without a need to operate a contrast adjusting function.

These and other objects, features, aspects and advantages of the present invention will become more apparent from the following detailed description of the present invention when taken in conjunction with the accompanying drawings.

BRIEF DESCRIPTION OF THE DRAWINGS

FIG. 8 illustrates a table used to judge the content feature in the first preferred embodiment of the present invention;

FIG. 21 is a table used to judge the content feature in the second preferred embodiment of the present invention;

FIG. 23 shows an example of output control values of an image quality adjustment control block 4 with respect to multiple content feature judge values F1 to F5 categorized in five genres;

FIG. 25 is a table used to detect a scene change in the third preferred embodiment of the present invention;

DESCRIPTION OF THE PREFERRED EMBODIMENTS

First Preferred Embodiment

Figure 1:
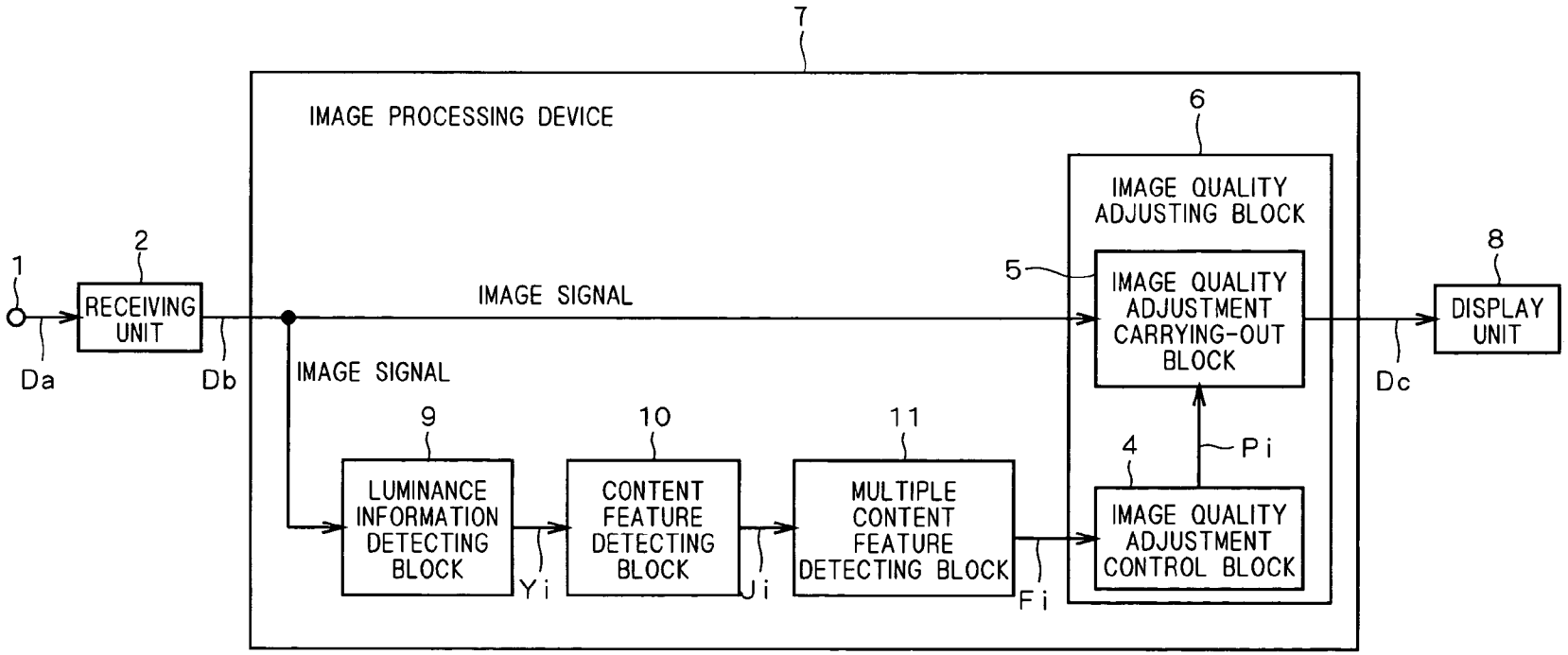
FIG. 1 is a block diagram illustrating the configuration of an image display apparatus according to a first preferred embodiment of the present invention.

FIG. 1 is a block diagram illustrating the configuration of an image display apparatus according to a first preferred embodiment of the present invention. The image display apparatus of the first preferred embodiment includes an input terminal 1, a receiving unit 2, an image processing device 7, and a display unit 8. The input terminal 1 receives input of an image signal Da of a given format adapted for television, computers, etc. The receiving unit 2 receives the image signal Da inputted to the input terminal 1, and converts the image signal Da into a format that can be processed in the image processing device 7, and outputs it as an image signal Db. For example, the receiving unit 2 converts the image signal Da into some digital image signals including a luminance signal Y, and outputs them as the image signal Db. For example, when the input image signal Da is an analog signal, the receiving unit 2 includes an A/D converter, and when the input image signal Da is a digital signal, the receiving unit 2 includes a given demodulator adapted to the digital format.

The image processing device 7 includes a luminance information detecting block 9, a content feature detecting block 10, a multiple content feature detecting block 11, and an image quality adjusting block 6 (a video correcting block), and the image quality adjusting block 6 includes an image quality adjustment control block 4 (a correction control block) and an image quality adjustment carrying-out block 5 (a video correction carrying-out block). The image signal Db outputted from the receiving unit 2 is inputted to the luminance information detecting block 9 and to the image quality adjustment carrying-out block 5 of the image processing device 7. From the luminance signal Y contained in the input image signal Db, the luminance information detecting block 9 detects a luminance information value Yi (a luminance-related information value) about individual pixels, and outputs the luminance information value Yi to the content feature detecting block 10. The content feature detecting block 10 judges the feature of one frame of the video content on the basis of the luminance information value Yi, and outputs a content feature judge information value Ji to the multiple content feature detecting block 11. On the basis of the content feature judge information value Ji, the multiple content feature detecting block 11 judges the feature of one frame or multiple frames of the video content, and outputs the multiple content feature information value Fi to the image quality adjustment control block 4. On the basis of the multiple content feature information value Fi, the image quality adjustment control block 4 calculates a correction parameter Pa that is used when the image quality adjustment carrying-out block 5 applies image quality adjustment to the image signal Db, and it outputs the correction parameter Pa to the image quality adjustment carrying-out block 5.

By using the inputted correction parameter Pi, the image quality adjustment carrying-out block 5 applies, e.g., gray-level adjustment, to the image signal Db, and outputs it as an image signal Dc to the display unit 8. The display unit 8 displays an image on the basis of the input image signal Dc. The display unit 8 can be, for example, a liquid-crystal display, DMD (Digital Micromirror Device) display, EL display, or plasma display, and it can be any display means of reflecting type, transmitting type, or self-emitting type.

Figure 2:
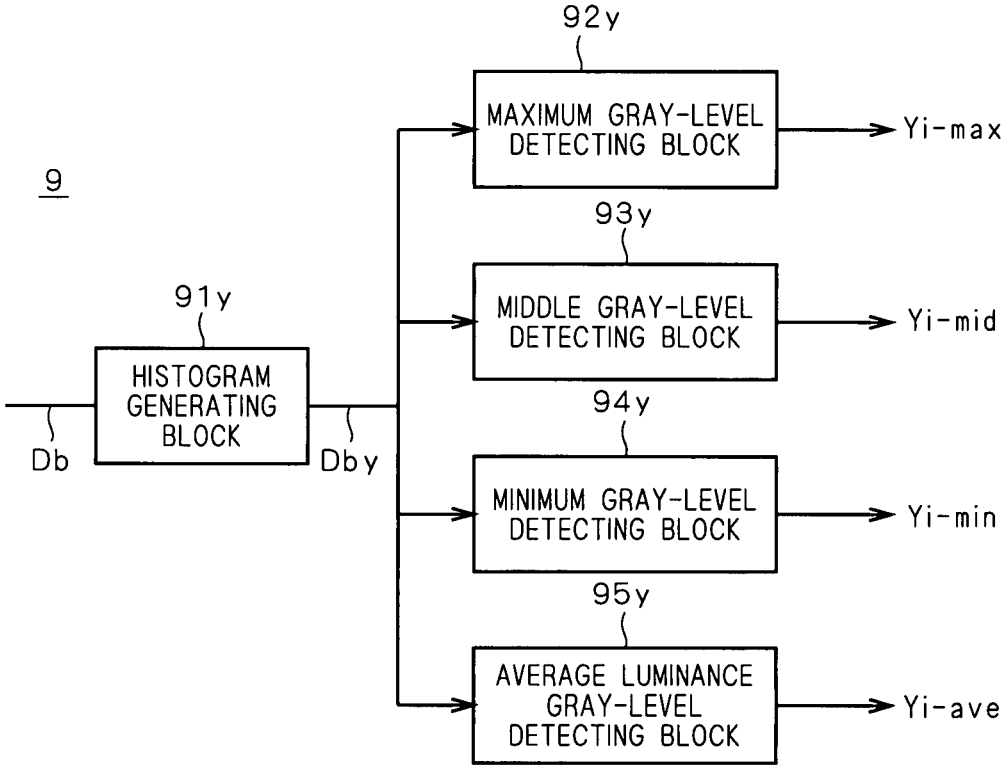
FIG. 2 is a block diagram illustrating the configuration of a luminance information detecting block of the first preferred embodiment of the present invention.

FIG. 2 is an example of a block diagram showing the detailed configuration of the luminance information detecting block 9. As shown in FIG. 2, the luminance information detecting block 9 of the first preferred embodiment includes a histogram generating block 91*y*, a maximum gray-level detecting block 92*y*, a middle gray-level detecting block 93*y*, a minimum gray-level detecting block 94*y*, and an average luminance gray-level detecting block 95*y*.

In this example, the luminance signal Y contained in the image signal Db outputted from the receiving unit 2 is inputted to the histogram generating block 91*y*.

When the input image signal Db is an interlace signal in which one frame of video signal is formed of two fields, the histogram about the luminance signal Y is generated by using two fields as one frame.

When the input image signal Db is of the RGB format, Y signal component may be calculated and inputted according to a known matrix operation. Or, in order to simplify the operating circuit, one of the R, G, B signals, e.g., G signal, may be used in place of the luminance signal Y.

While the luminance information detecting block 9 generates a histogram about the luminance signal Y in one frame of the image signal Db, the accumulation is built up only in the video (image) effective period. It is desired that the following image quality correction processing be finished within the video blanking period, and so it is desired that the luminance information be outputted promptly when the video effective period ends. If the measurement for the accumulation for the histogram is performed also in the video blanking period, the value on the black side in the histogram will become undesirably large, because the video blanking period other than the video effective period is black (gray level 0). Also, digital data information may be superimposed in video blanking periods, and so the luminance information may be undesirably changed by the data information.

The histogram generating block 91*y* generates a histogram about the luminance signal Y of one frame or multiple frames of the image signal Db. On the basis of the histogram generated by the histogram generating block 91*y*, the maximum gray-level detecting block 92*y* detects a luminance-signal maximum gray-level value about the image signal Db, and outputs a maximum gray-level information value Yi-max. Also, on the basis of the histogram generated by the histogram generating block 91*y*, the middle gray-level detecting block 93*y* detects a luminance-signal middle gray-level value about the image signal Db, and outputs a middle gray-level information value Yi-mid. Also, on the basis of the histogram generated by the histogram generating block 91*y*, the minimum gray-level detecting block 94*y* detects a luminance minimum gray-level value about the image signal Db, and outputs a minimum gray-level information value Yi-min. Also, on the basis of the histogram generated by the histogram generating block 9 1*y*, the average luminance gray-level detecting block 95*y* detects a luminance-signal average gray-level value about the image signal Db, and outputs an average gray-level information value Yi-ave.

Figure 3:
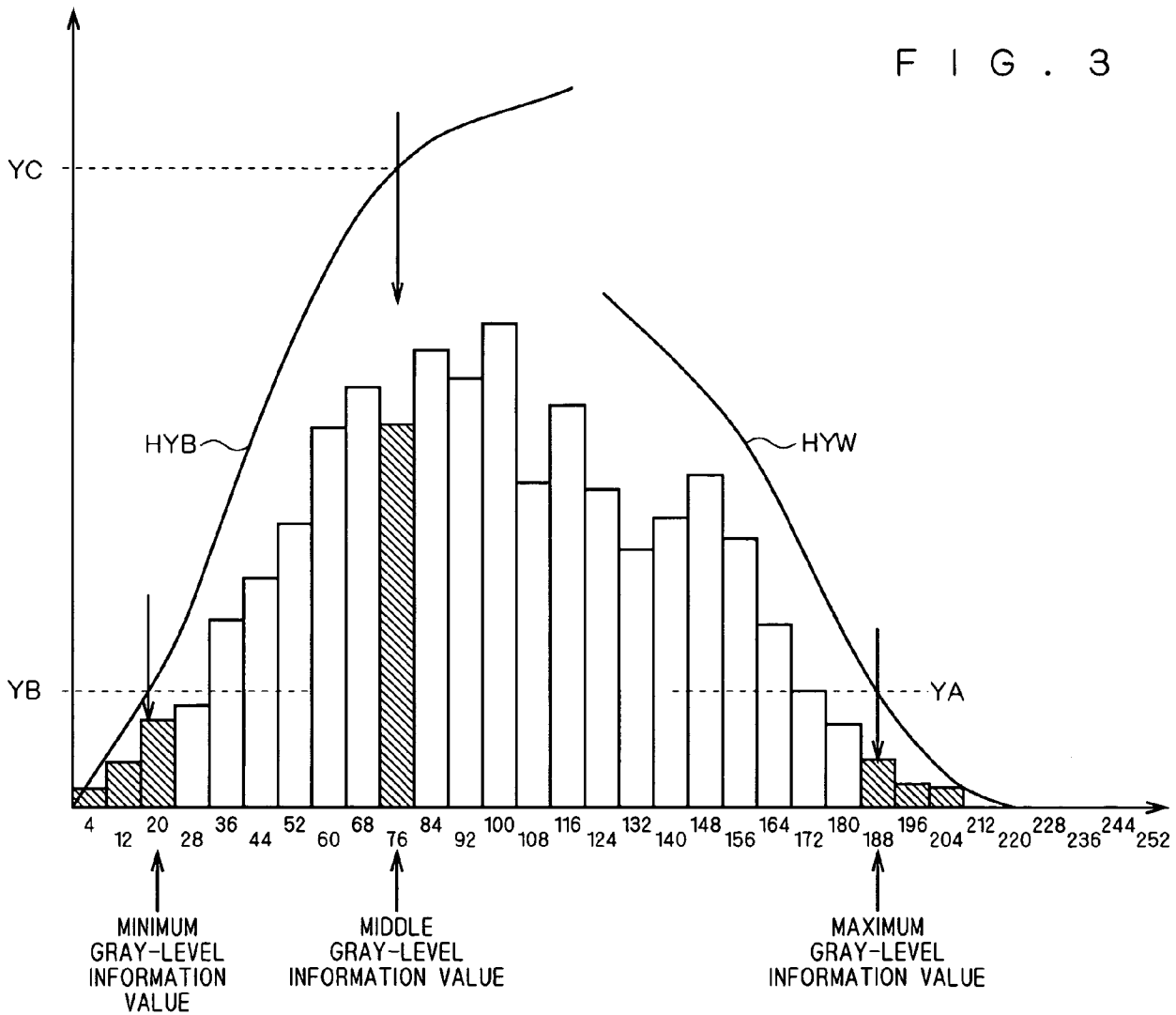
FIG. 3 is a diagram illustrating an evenly divided histogram and conditions about luminance information generated in a histogram generating block of the first preferred embodiment of the present invention.

FIG. 3 is a diagram showing an example of the histogram about one frame generated by the histogram generating block 91*y*. In the diagram, the horizontal axis shows gray-level values (classes), and the vertical axis shows frequencies, i.e., the numbers of pixels with respect to the luminance of the one frame of image signal Db. In the description below, the luminance signal Y of the image signal Db is formed of, e.g., 8-bit data, and the gray level values take values from "0" to "255" and the number of gray levels is "256".

For example, the histogram generating block 91*y* of the first preferred embodiment divides the 256 gray levels into 32 ranges each including 8 gray levels, where the 32 ranges correspond to the classes in the histogram. In each class, a value in the vicinity of the center value is adopted as its representative value. In this example, an integer that is closest to and larger than the center value is adopted as the representative value of that class. For example, in the class formed of gray level values "0" to "7", the center value is "3.5", and so the representative value of that class is "4". The figures on the horizontal axis of FIG. 3 show the representative values of the individual classes.

When the center value of a class is an integer, that center value may be adopted as the representative value of that class. Also, even when the center value of a class is not an integer but a decimal fraction as shown in this example, the center value of the class may be adopted as the representative value of the class. When the center value of a class is a decimal fraction, the amount of operation can be reduced by adopting an integer in the vicinity of the center value of the class, as the representative value of the class, as shown in this example.

In this way, the histogram generating block 91*y* of the first preferred embodiment forms one class with consecutive eight gray level values, and so each frequency in the histogram shown in FIG. 3 corresponds to the sum total of signals at the eight gray levels. For example, the frequency shown at the FIG. 4 on the horizontal axis corresponds to the sum total of signals at the gray level values 0 to 7 that are included in the one frame of the image signal Db.

Alternatively, unlike the histogram shown in FIG. 3, a histogram may be generated by counting the frequency for each gray level value. That is, each class may include one gray level value. In this case, the representative value of each class is the gray level value itself that forms the class. When the gray level values are divided into ranges, the number of divisions may be some other number than 32, and the amount of operation in the histogram generating block 91*y* can be reduced by reducing the number of divisions. The number of divisions is determined on the basis of the amount of processible operations and the accuracy of the image quality adjustment required in the image quality adjusting block 6.

From the histogram generated in this way, the maximum gray-level detecting block 92*y* accumulates the frequencies from the maximum class toward the minimum class to obtain an accumulated frequency HYW, and extracts the representative value of the class in which the accumulated frequency HYW first exceeds a given threshold YA. The maximum gray-level detecting block 92*y* then outputs the extracted value as the maximum gray-level information value Yi-max.

Also, from the histogram generated in the histogram generating block 91*y*, the minimum gray-level detecting block 94*y* accumulates the frequencies from the minimum class toward the maximum class to obtain an accumulated frequency HYB, and extracts the representative value of the class in which the accumulated frequency HYB first exceeds a given threshold YB. The minimum gray-level detecting block 94*y* then outputs the extracted representative value as the minimum gray-level information value Yi-min.

Also, from the histogram generated in this way, the middle gray-level detecting block 93*y* accumulates the frequencies from the minimum class toward the maximum class to obtain an accumulated frequency HYB, and extracts the representative value of the class in which the accumulated frequency HYB first exceeds a given threshold YC (for example, half of the total number of pixels). The middle gray-level detecting block 93*y* then outputs the extracted representative value as the middle gray-level information value Yi-mid. The middle gray level may be detected by using the accumulated frequency HYW.

In the histogram shown in FIG. 3, the accumulated frequency HYW first exceeds the threshold YA in the class whose representative value is "188", and so the value "188" is the maximum gray-level information value Yi-max. The maximum gray-level information value Yi-max is not the maximum gray-level value of the image signal Db, but a value based on the maximum gray-level value detected by using the accumulated frequency HYW and the threshold YA.

In the histogram shown in FIG. 3, the accumulated frequency HYB first exceeds the threshold YB in the class whose representative value is "20", and so the value "20" is the minimum gray-level information value Yi-min. The minimum gray-level information value Yi-min is not the minimum gray-level value of the image signal Db, but is a value based on the minimum gray-level value detected by using the accumulated frequency HYB and the threshold YB.

Also, the accumulated frequency HYB first exceeds the threshold YC in the class whose representative value is "76", and so the value "76" is the middle gray-level information value Yi-mid. Usually, the middle gray-level information value Yi-mid corresponds to the gray level value at which half (50%) of the total number of pixels of the image signal Db is reached.

The average luminance gray-level detecting block 95*y* calculates an average luminance gray-level information value about the luminance signal Dby, from the luminance signal Dby obtained from one frame of the image signal Db, and outputs the value as the luminance-signal average gray-level information value Yi-ave. Specifically, when the luminance-signal gray level values are indicated as Yi and the number of pixels in each luminance-signal gray level value is indicated as nYi, then it is calculated by Expression (1) below:

$$\text{Luminance signal average}=\Sigma(Yi\times nYi)/\Sigma nYi \quad (1).$$

The average luminance-signal gray-level value (the luminance signal average by Expression (1)) is outputted as the luminance-signal average gray-level information value Yi-ave.

While the accumulated frequencies HYW, HYB etc. in this example are generated by the histogram generating block 91*y*, they may be generated in the maximum gray-level detecting block 92*y* and the middle gray-level detecting block 93*y*, the minimum gray-level detecting block 94*y*, and the average luminance gray-level detecting block 95*y*.

Also, while the histogram generating block 91*y* of this example evenly divides the histogram, the histogram may be unevenly divided such that the ranges of gray level values for which frequencies are counted can be set freely. This makes it possible to reduce the amount of operations and to set more detailed conditions for the minimum luminance information value and maximum luminance information value.

As to the ranges of gray levels in the histogram, the gray levels may be divided into smaller ranges only for the minimum luminance information value, the gray levels may be divided into smaller ranges only for the middle luminance information value, or the gray levels may be divided into smaller ranges only for the maximum luminance information value. Also, the intervals of the gray levels may be chosen according to the feature of the content to be detected.

The luminance information detecting block 9 of FIG. 2 is shown by way of example, and the luminance information detecting block 9 can be any means that outputs luminance information value on the basis of the luminance signal Y contained in the image signal Db.

Figure 4:
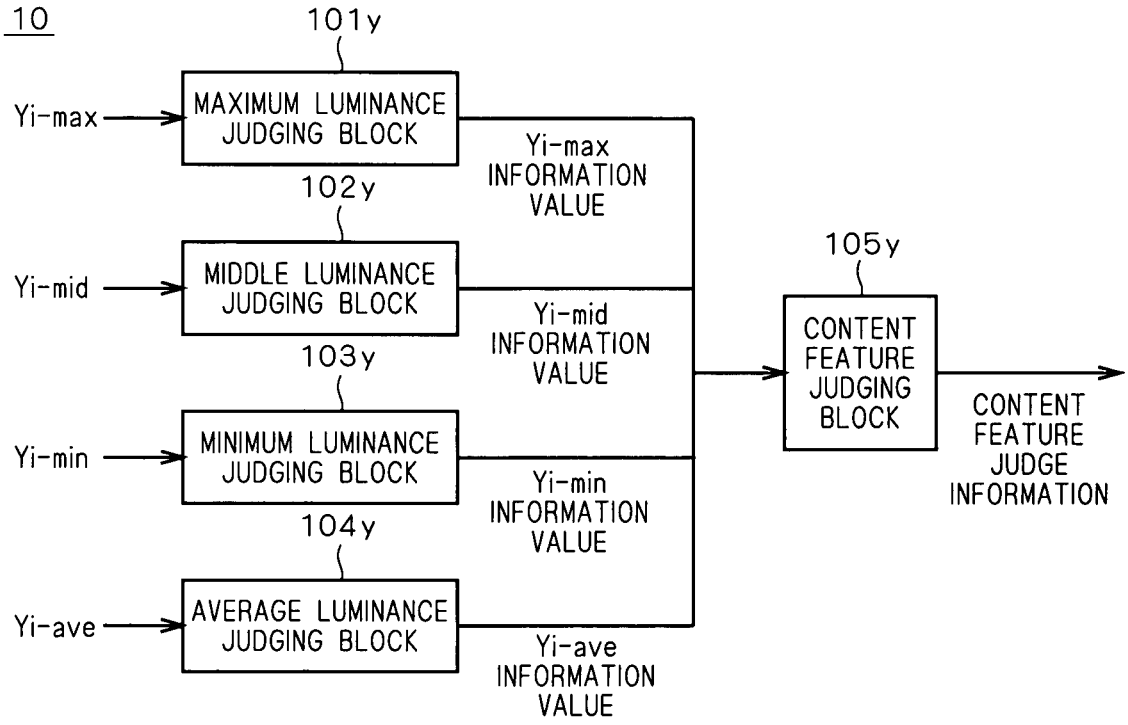
FIG. 4 is a block diagram illustrating a content feature detecting block of the first preferred embodiment of the present invention.

FIG. 4 is an example of a block diagram showing the detailed configuration of the content feature detecting block 10. As shown in FIG. 4, the content feature detecting block 10 of the first preferred embodiment includes a maximum luminance judging block 101*y*, a middle luminance judging block 102*y*, a minimum luminance judging block 103*y*, an average luminance judging block 104*y*, and a content feature judging block 105*y*.

The maximum gray-level information value Yi-max outputted from the luminance information detecting block is inputted to the maximum luminance judging block 101*y*, the middle gray-level information value Yi-mid is inputted to the middle luminance judging block 102*y*, the minimum gray-level information value Yi-min is inputted to the minimum luminance judging block 103*y*, and the average gray-level information value Yi-ave is inputted to the average luminance judging block 104*y*.

On the basis of the maximum gray-level information value Yi-max, the maximum luminance judging block 101*y* categorizes the magnitude of the maximum luminance, and generates a category information as Yi-max information value. The middle luminance judging block 102*y* categorizes the magnitude of the middle luminance from the middle gray-level information value Yi-mid, and generates a category information as Yi-mid information value. The minimum luminance judging block 103*y* categorizes the magnitude of the minimum luminance from the minimum gray-level information value Yi-min, and generates a category information as Yi-min information value. The average luminance judging block 104*y* categorizes the magnitude of the average luminance from the average gray-level information value Yi-ave, and generates a category information as Yi-ave information value.

Figure 5:
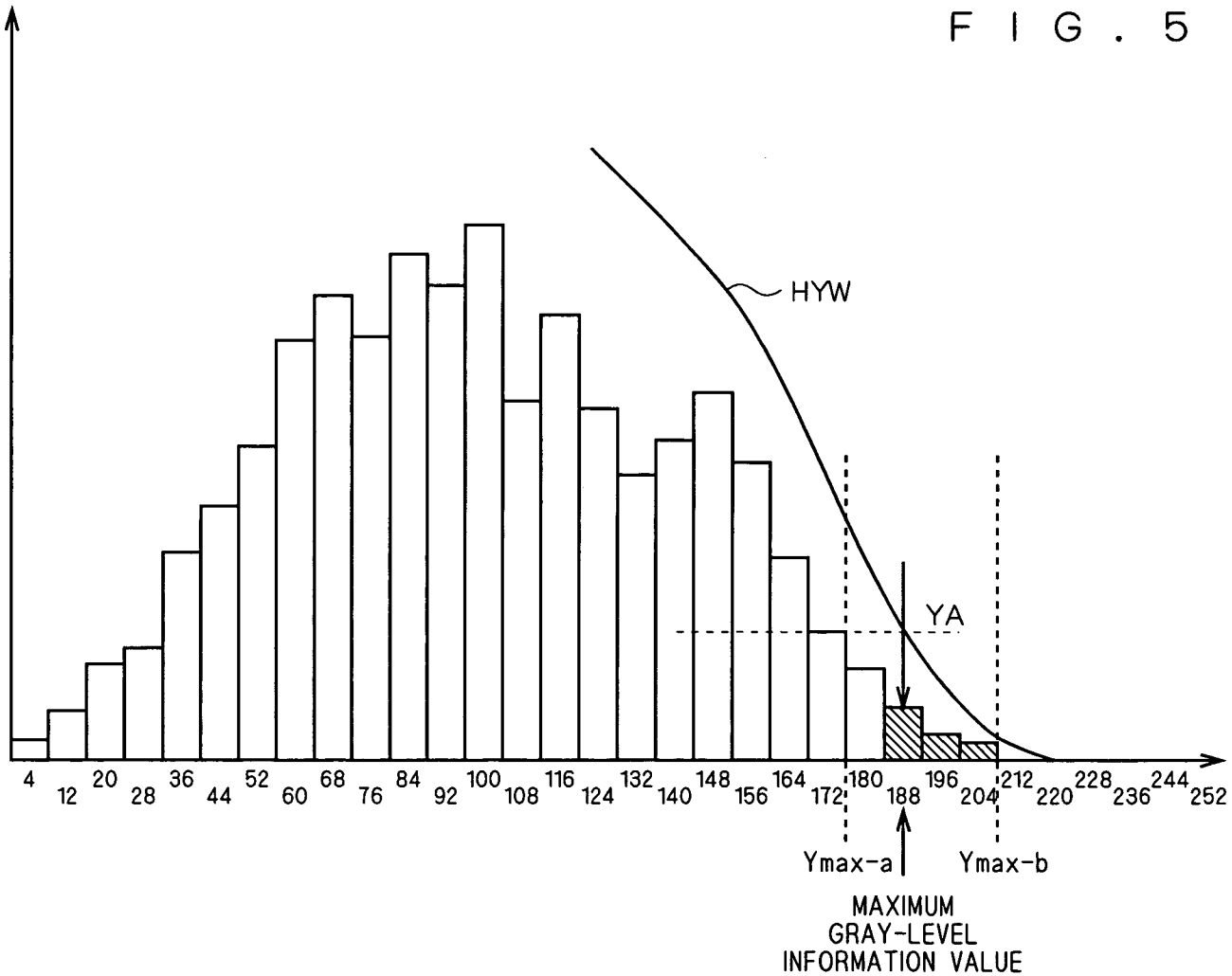
FIG. 5 is a diagram illustrating a threshold condition for maximum luminance information in the first preferred embodiment of the present invention.

Specifically, as shown in FIG. 5, the maximum luminance judging block 101*y* checks whether the maximum gray-level information value Yi-max is smaller than a given maximum luminance judge threshold Ymax-a, or between the given threshold Ymax-a and a larger given threshold Ymax-b, or larger than the maximum luminance judge threshold Ymax-b, and outputs one of three category information values Yi-max-small, Yi-max-middle, and Yi-max-large, which is inputted to the content feature judging block 105*y*. More specifically, in the example of FIG. 5, the value is between the given threshold Ymax-a and the larger given threshold Ymax-b, and so the information value Yi-max-middle is outputted to the content feature judging block 105*y*.

Figure 6:
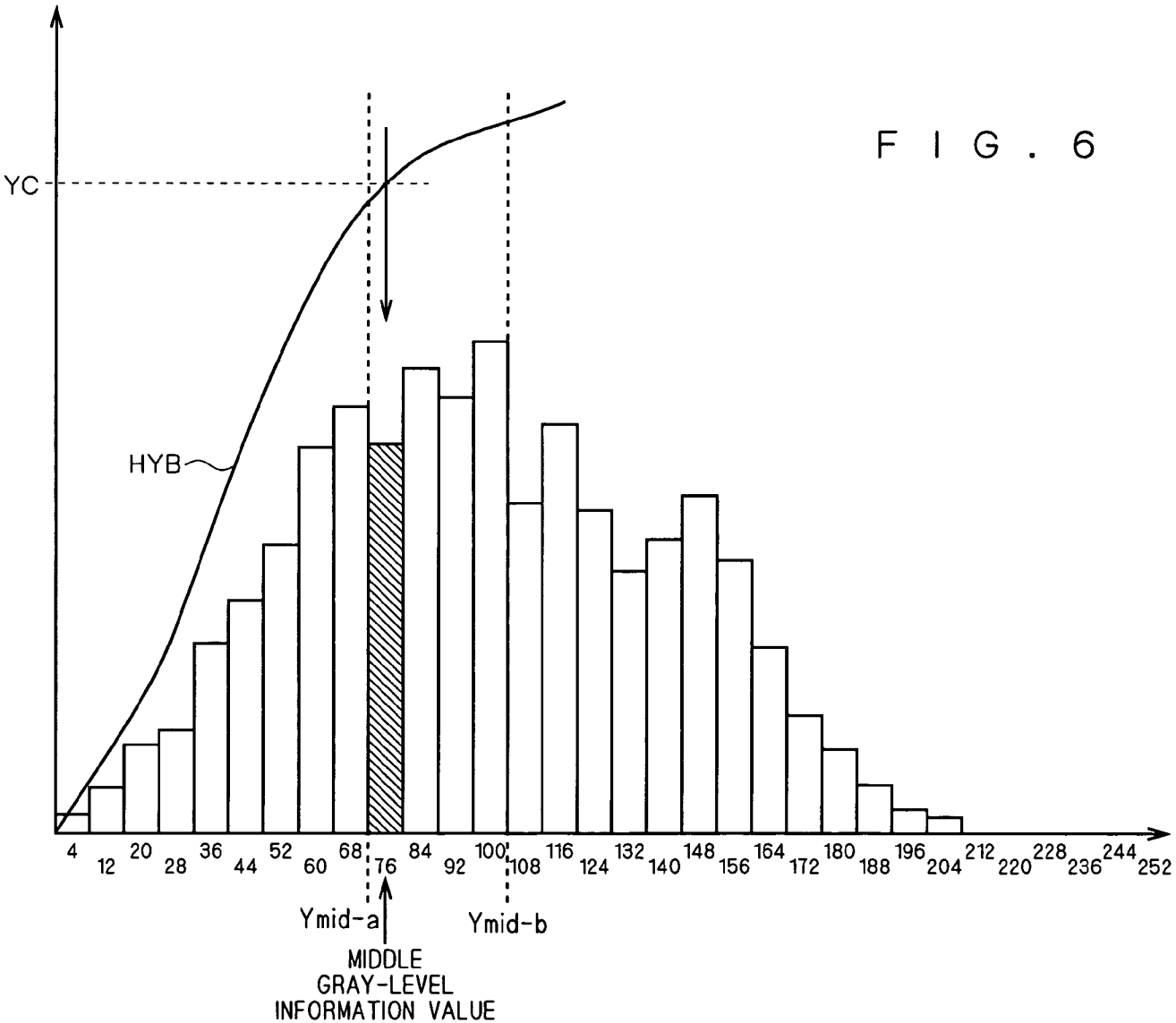
FIG. 6 is a diagram illustrating a threshold condition for middle luminance information in the first preferred embodiment of the present invention.

Also, as shown in FIG. 6, the middle luminance judging block 102*y* checks whether the middle gray-level information value Yi-mid is smaller than a given middle luminance judge threshold Ymid-a, or between the given threshold Ymid-a and a larger given threshold Ymid-b, or larger than the middle luminance judge threshold Ymid-b, and outputs one of three category information values Yi-mid-small, Yi-mid-middle, and Yi-mid-large, which is inputted to the content feature judging block 105*y*. More specifically, in the example of FIG. 6, the value is between the given threshold Ymid-a and the larger given threshold Ymid-b, and so the information value Yi-mid-middle is outputted to the content feature judging block 105*y*.

Figure 7:
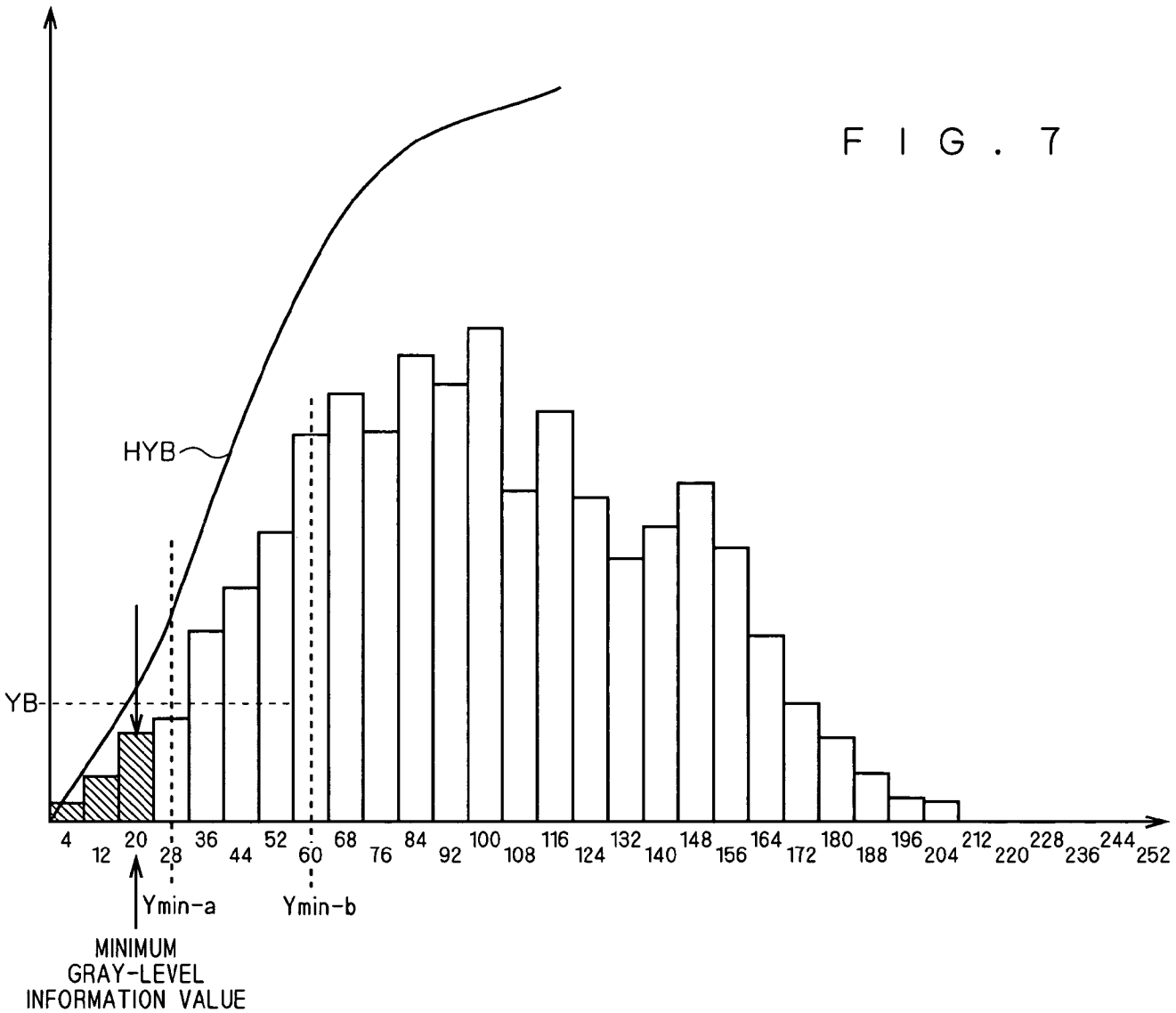
FIG. 7 is a diagram illustrating a threshold condition for minimum luminance information in the first preferred embodiment of the present invention.

Also, as shown in FIG. 7, the minimum luminance judging block 103*y* checks whether the minimum gray-level information value Yi-min is smaller than a given minimum luminance judge threshold Ymin-a, or between the given threshold Ymin-a and a larger given threshold Ymin-b, or larger than the minimum luminance judge threshold Ymin-b, and outputs one of three category information values Yi-min-small, Yi-min-middle, and Yi-min-large, which is inputted to the content feature judging block 105*y*. More specifically, in the example of FIG. 7, the value is smaller than the given threshold Ymin-a, and so the information value Yi-min-small is outputted to the content feature judging block 105*y*.

Also, the average luminance judging block 104*y* checks whether the average gray-level information value Yi-ave calculated by Expression (1) is smaller than a given average luminance judge threshold Yave-a, or between the given threshold Yave-a and a larger given threshold Yave-b, or larger than the average luminance judge threshold Yave-b, and outputs one of three category information values Yi-ave-small, Yi-ave-middle, and Yi-ave-large, which is inputted to the content feature judging block 105*y*.

On the basis of the combination of the four luminance information values, the content feature judging block 105*y* judges the content feature according to a table of combinations as shown in FIG. 8. The content feature judging block outputs the content feature judge information value Ji to the multiple content feature detecting block 11. The table of combinations for determining the content feature can be arbitrarily created on the basis of the viewer's tastes or a video database. For example, when the average gray-level information value Yi-ave is small, the minimum gray-level information value Yi-min is small, the middle gray-level information value Yi-mid is small, and the maximum gray-level information value Yi-max is small, then the content feature is judged to be a feature kind J1, which is outputted to the multiple content feature detecting block 11.

The content feature judging block 105*y* may make the judgment by using three or less of the four luminance information values. For example, information can be chosen such that the content feature is categorized with the average luminance information value alone, or with two values including the average luminance information value and the maximum luminance information value. By reducing the amount of information in this way, it is possible to increase the speed for detecting the feature and to reduce the amount of required memory capacity.

The content feature detecting block 10 of FIG. 4 is shown by way of example, and the content feature detecting block 10 can be configured in other ways as long as it outputs the content feature judge information value Ji on the basis of the luminance information value Yi, and the amount of information may be increased by, e.g., using zero gray level or highest gray level as well as the minimum luminance, middle luminance and maximum luminance information values, or the amount of information may be reduced by, e.g., using the minimum and maximum values only.

The content feature judge information value Ji based on the luminance information value Yi may be outputted by calculating likelihood of the luminance information value Yi and obtaining the content feature judge information value Ji through statistical processing, for example.

The multiple content feature detecting block 11 performs arithmetic operation on the basis of the inputted content feature judge information values Ji and obtains a multiple content feature information value Fi that reflects the content feature judge information values Ji about multiple frames in the same that described in the first preferred embodiment. This makes it possible to judge the content more stably and more accurately, than just using the content feature judge information values Ji about multiple frames.

In one method of the arithmetic operation in the multiple content feature detecting block 11, the multiple content feature detecting block 11 counts kinds of the feature indicated by the content feature judge information values Ji, each about one frame, on the basis of the inputted content feature judge information values Ji, and determines the multiple content feature information value Fi when the content feature judge information values Ji indicated the same value (the same feature kind) for a given judge number N of times.

Figure 9:
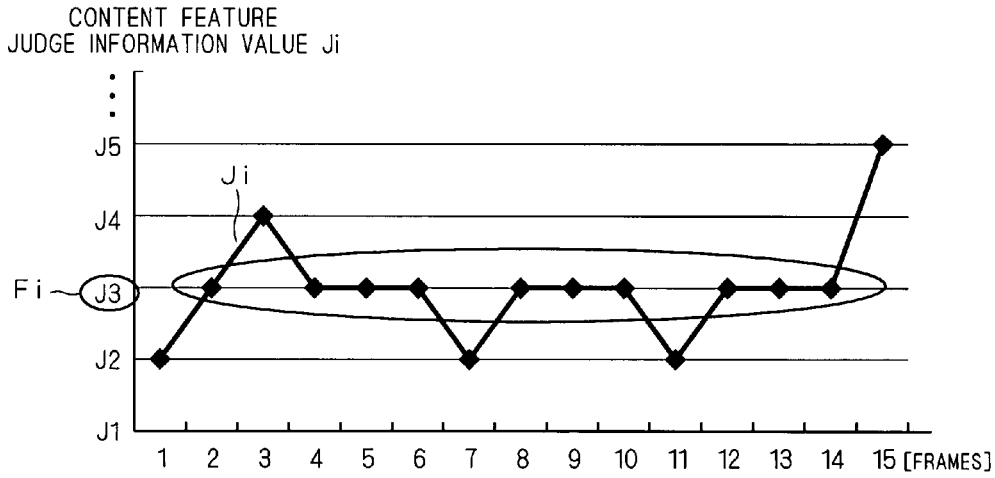
FIG. 9 is a diagram showing an example of a multiple content feature information value determined in a multiple content feature detecting block of the first preferred embodiment of the present invention.

Specifically, as shown in FIG. 9, when the given judge number N is "10", for example, the kinds of the feature indicated by the content feature judge information values Ji, each about one frame, are counted for a plurality of frames. In this example, a feature kind J3 indicated by the content feature judge information values Ji achieves the given judge number 10 earliest, and so the feature kind J3 is determined to be the multiple content feature information value Fi and inputted to the image quality adjustment control block 4.

In another method, the multiple content feature detecting block 11 counts the kind of the feature indicated by the content feature judge information values Ji, each about one frame, on the basis of the inputted content feature judge information values Ji, and determines the multiple content feature information value Fi when the content feature judge information values Ji consecutively indicated the same value (the same feature kind) for a given judge number N of times.

Figure 10:
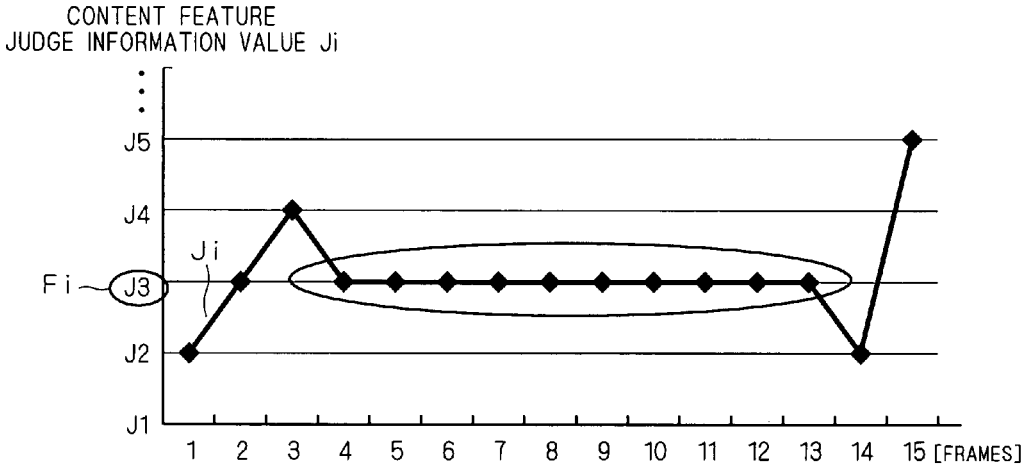
FIG. 10 is a diagram showing an example of a multiple content feature information value determined in the multiple content feature detecting block of the first preferred embodiment of the present invention.

Specifically, as shown in FIG. 10, when the given judge number N is "10", the kinds of the feature indicated by the content feature judge information values Ji, each about one frame, are counted for a plurality of frames. In this example, the content feature judge information values Ji consecutively indicate the feature kind J3 from the fourth frame to the thirteenth frame. The feature kind J3 thus consecutively achieves the given judge number 10 earliest. Accordingly, the feature kind J3 is determined to be the multiple content feature information value Fi and inputted to the image quality adjustment control block 4.

In still another method, the multiple content feature detecting block 11 counts the kinds of the feature indicated by the content feature judge information values Ji, each about one frame, on the basis of the inputted content feature judge information values Ji, and determines the multiple content feature information value Fi when the content feature judge information values Ji indicated the same value (the same feature kind) with a maximum frequency of appearance within a given judge number N of frames.

Figure 11:
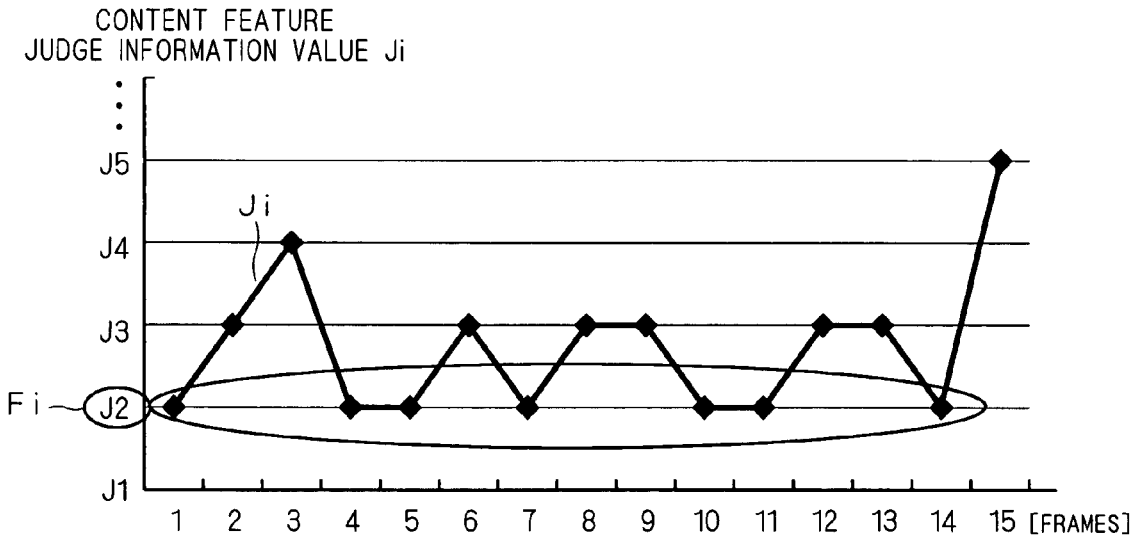
FIG. 11 is a diagram showing an example of a multiple content feature information value determined in the multiple content feature detecting block of the first preferred embodiment of the present invention.
Figure 12A:
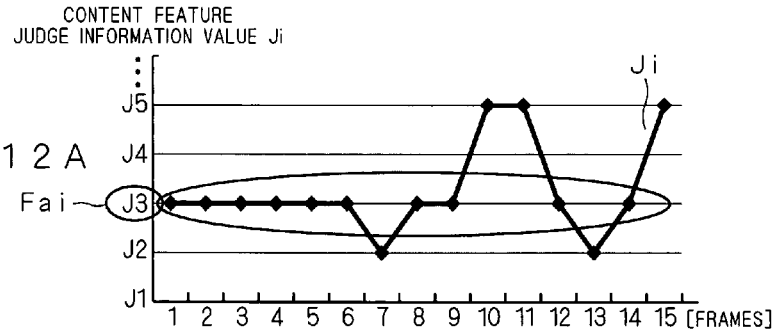
FIGS. 12A to 12D are diagrams showing an example of a multiple content feature information value determined in the multiple content feature detecting block of the first preferred embodiment of the present invention.
Figure 12B:
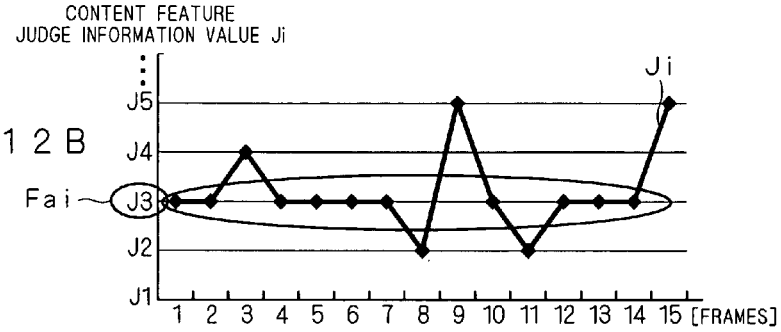
Figure 12C:
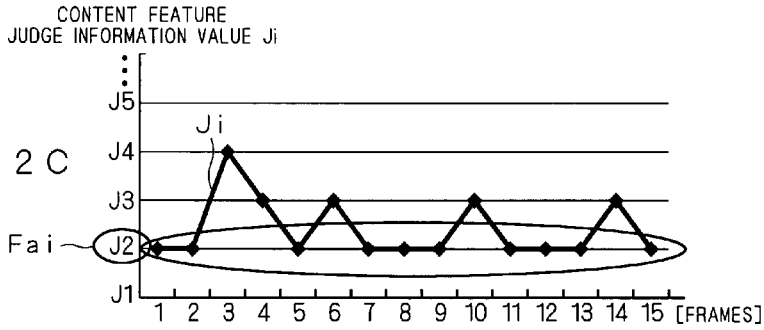
Figure 12D:
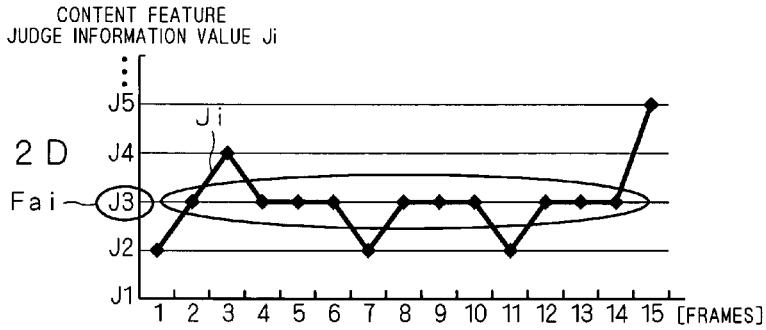

Specifically, as shown in FIG. 11, when the given judge number N is "15", for example, the kinds of the feature indicated by the content feature judge information values Ji, each about one frame, are counted for 15 frames corresponding to the given judge number. In this example, within the 15 frames, the feature kind JI appears 0 times, a feature kind J2 appears 7 times, the feature kind J3 appears 6 times, and feature kinds J4 and J5 each appear once. The feature kind J2, appearing 7 times, has the maximum frequency of appearance. Accordingly, the feature kind J2 is determined to be the multiple content feature information value Fi and inputted to the image quality adjustment control block 4.

The multiple content feature detecting block 11 of the first preferred embodiment may output the content feature judge information value Ji as the multiple content feature information value Fi.

Also, the multiple content feature detecting block 11 of the first preferred embodiment may use a combination of a plurality of arithmetic operations such as the three typical methods described above.

For example, the multiple content feature information value Fi may be determined by a combinational method in which the kinds of the feature indicated by the content feature judge information values Ji, each about one frame, are counted until a given judge number Na is achieved, and then the kinds of the feature, each about one frame, are counted until the same value consecutively achieves a given judge number Nb.

Also, in another combinational method, the kinds of the feature indicated by the content feature judge information values Ji, each about one frame, are counted while using a given judge number Na, so as to obtain a (assumed) multiple content feature information value Fai, and then the kinds of the feature indicated by the multiple content feature information values Fai are counted to obtain the multiple content feature information value Fi. In this example, operations are done twice in combination, but operations may be done three times or more in combination.

Specifically, as shown in FIGS. 12A to 12D, when the given judge number Na is "10" and Nb is "3", first, the kind of the feature indicated by the content feature judge information values Ji, each about one frame, are counted until the same value achieves the given judge number "10", so as to obtain the multiple content feature information value Fai. Next, the multiple content feature information values Fai are obtained in the same way from the content feature judge information values Ji, until the given judge number 3 is achieved earliest. In this example, the feature kind indicated by the multiple content feature information values Fai are sequentially obtained as the feature kinds J3, J3, J2, J3. Thus, the feature kind J3 is the feature kind indicated by the multiple content feature information value Fai that achieves 3 times earliest, and so the feature kind J3 is determined to be the multiple content feature information value Fi and inputted to the image quality adjustment control block 4.

In this way, by obtaining the multiple content feature value through a combinational method, it is possible to control the speed and accuracy in determining the multiple content feature information value Fi, and hence to realize highly adaptable image quality adjustment.

According to the multiple content feature detecting block 11 of the first preferred embodiment, when the content drastically varies in a certain single frame, the content feature judge information value Ji about that frame is removed by the arithmetic operation, which prevents extreme image quality adjustment from being applied. Also, the image quality adjustment is not effected for each content feature information value about one frame, and thus the image quality adjustment is applied less frequently and the processing speed is enhanced.

The multiple content feature detecting block 11 is applicable not only to image display apparatuses but also to other fields related to video, as a method for more accurately determining the amount of feature of video content on the basis of luminance information value.

Figure 13:
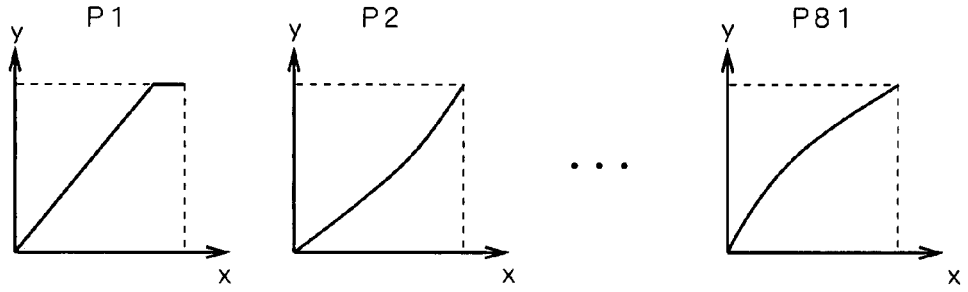
FIG. 13 is a diagram used to describe operation of a correction control block of the first preferred embodiment of the present invention.

On the basis of the inputted multiple content feature information value Fi, the image quality adjustment control block 4 selects a gray-level characteristic, such as a correction parameter Pi, in correspondence with the content feature, and outputs it to the image quality adjustment carrying-out block 5. FIG. 13 is a diagram illustrating an example of the operation of the image quality adjustment control block 4 that performs gray-level characteristic transformation. As shown in FIG. 13, in an x-y coordinate system in which the x axis shows gray level values of the input signal (image signal Db) and the y axis shows outputted gray level values (image signal Dc), the image quality adjustment control block 4 selects a transformation formula in correspondence with the judgment of content feature. Specifically, the transformation graph P1 is selected when the combination 1 shown in FIG. 8 is selected.

Correction parameters Pi of the same number as the combinations of luminance information values may be prepared (81 in this example), or correction parameters Pi of the same number as the kinds of content features may be prepared.

The image quality adjustment carrying-out block 5 performs gray level correction on the basis of the correction parameter Pi. The gray level correction is applied for each frame.

In order to enhance the accuracy of the judgment of genre, the multiple content feature detecting block 11 may utilize the detection of film source, or the judgment as movie, provided in a known interlace-progressive (IP) conversion circuit, or it may utilize such genre information in a digital program table as described in Patent Document 1.

As described so far, on the basis of the content feature information determined about each frame on the basis of luminance information values, the image display apparatus of the first preferred embodiment determines the feature of content according to the amounts of feature over a plurality of frames, and so the image display apparatus is capable of more accurately judging the characteristic of the content. Also, since the image quality adjustment is applied to the image signal Db on the basis of the judgment, the image quality adjustment is not very frequently performed, and the image quality adjustment can be performed in a most suitable way.

In this example, determining the content feature by using the technique of Patent Document 2 requires identifying key frames for characterizing the content, and on the basis of the information, retaining frame numbers associated with the key frames throughout the procedure.

In contrast, the image display apparatus of the first preferred embodiment is capable of determining the content feature in real time and applying most suitable image quality adjustment for each frame, by extracting the feature for each frame, judging the content feature, and applying image quality adjustment to the image signal Db.

Patent Document 3 does not determine the content feature and genre of the video signal. In contrast, by applying this preferred embodiment, it is possible to judge the content feature and genre only with luminance information about the input video signal, and then it is possible to apply not only luminance correction but also various image quality corrections in correspondence with the content feature and genre, such as corrections of colors, sharpness, moving picture response, device control, etc.

Second Preferred Embodiment

Figure 14:
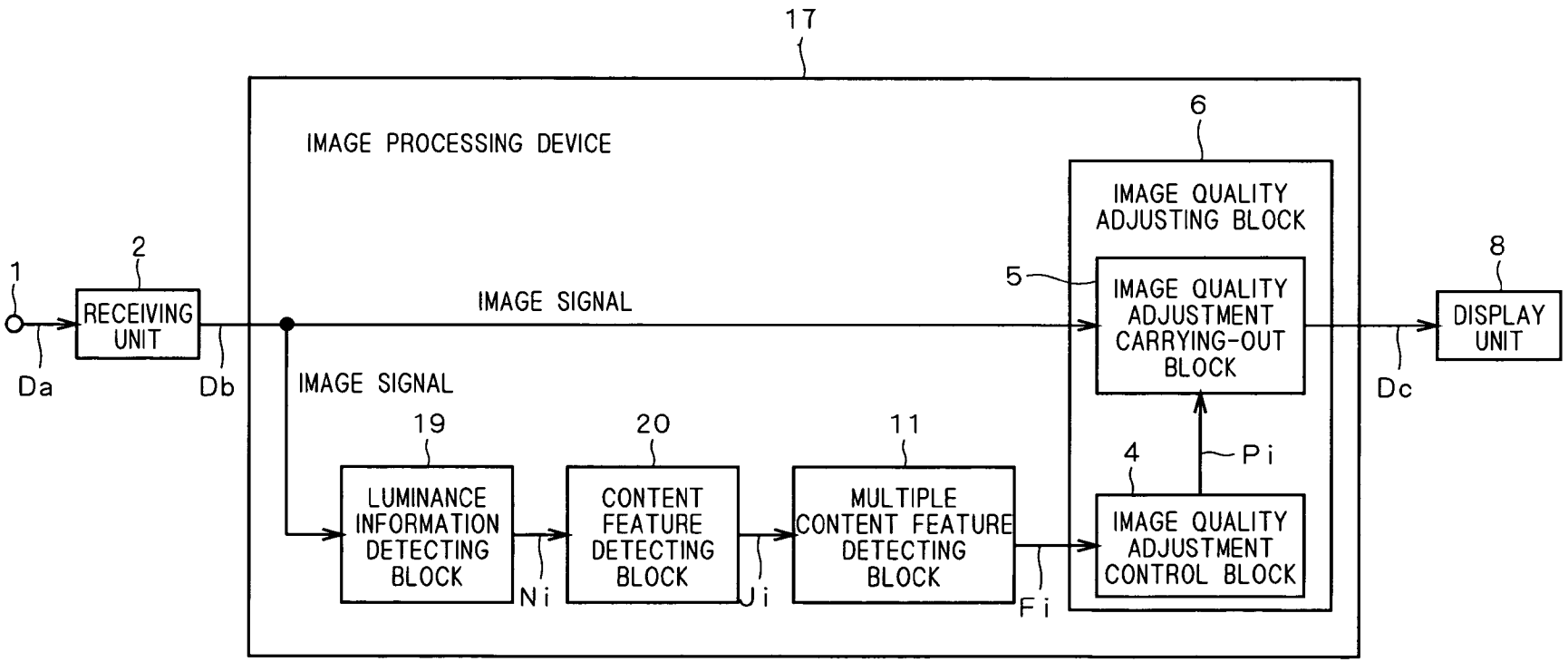
FIG. 14 is a block diagram illustrating the configuration of an image display apparatus according to a second preferred embodiment of the present invention.

FIG. 14 is a block diagram illustrating the configuration of an image display apparatus according to a second preferred embodiment of the present invention. The image display apparatus of the second preferred embodiment includes an image processing device 17 in place of the image processing device 7 of the image display apparatus of the first preferred embodiment.

The image processing device 17 of the second preferred embodiment includes a content feature detecting block 20, a luminance information detecting block 19, a multiple content feature detecting block 11, and the image quality adjusting block 6 of the first preferred embodiment. The luminance information detecting block 19 receives a luminance signal Y contained in an image signal Db outputted from the receiving unit 2, and it detects luminance information about individual pixels from the luminance signal Y, generates a histogram, and outputs a pixel number information value Ni (luminance-related information value) obtained from the histogram.

The image quality adjusting block 6 includes the image quality adjustment control block 4 and the image quality adjustment carrying-out block 5 of the first preferred embodiment. The image quality adjustment control block 4 of the second preferred embodiment is the same as that of the first preferred embodiment, and the image quality adjusting block 6 and the display unit 8 operate exactly the same as those described in the first preferred embodiment, and so not described in detail again here.

Figure 15:
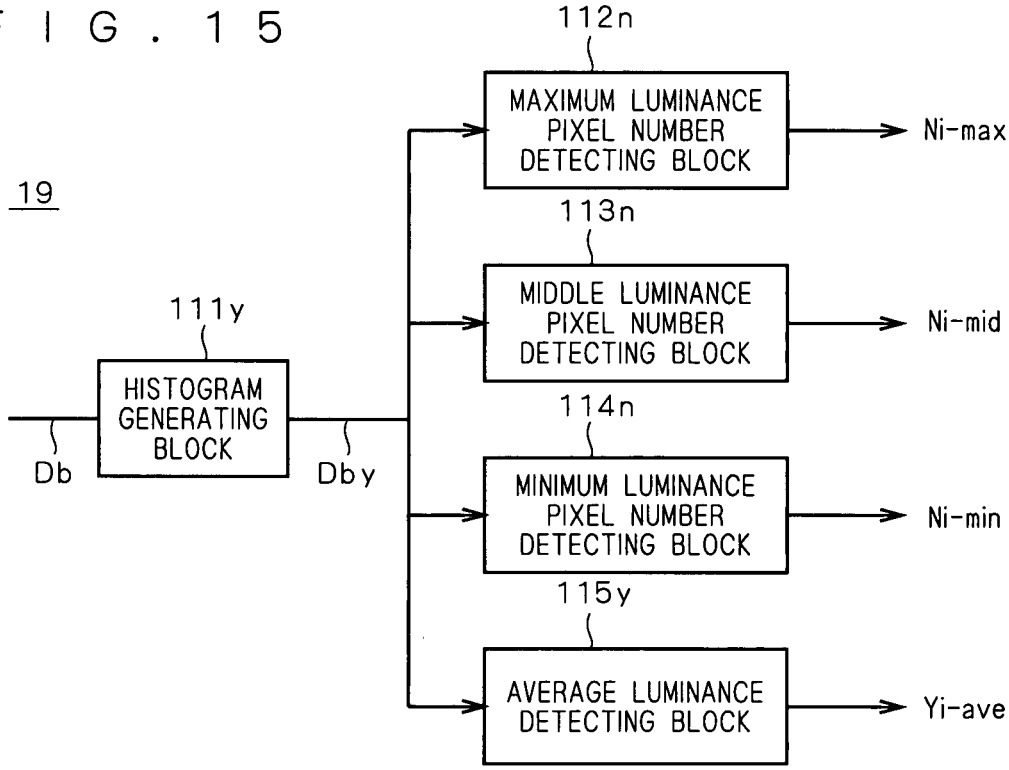
FIG. 15 is a block diagram illustrating the configuration of a luminance information detecting block of the second preferred embodiment of the present invention.

FIG. 15 is a block diagram illustrating the detailed configuration of the luminance information detecting block 19.

As shown in FIG. 15, the luminance information detecting block 19 of the second preferred embodiment includes a histogram generating block 111*y*, a maximum luminance pixel number detecting block 112*n*, a middle luminance pixel number detecting block 113*n*, a minimum luminance pixel number detecting block 114*n*, and an average luminance detecting block 115*y*.

The luminance signal Y contained in the image signal Db outputted from the receiving unit 2 is inputted to the histogram generating block 111*y*.

The histogram generating block 111*y* generates a histogram about the luminance signal DbY of one frame of the image signal Db. On the basis of the histogram generated by the histogram generating block 111*y*, the maximum luminance pixel number detecting block 112*n* detects the number of maximum luminance pixels in the one frame of image signal Db, and outputs a maximum luminance pixel number information value Ni-max. Also, on the basis of the histogram generated by the histogram generating block 111*y*, the middle luminance pixel number detecting block 113*n* detects the number of middle luminance pixels in the one frame of image signal Db, and outputs a middle luminance pixel number information value Ni-mid. Also, on the basis of the histogram generated by the histogram generating block 111*y*, the minimum luminance pixel number detecting block 114*n* detects the number of minimum luminance pixels in the one frame of image signal Db, and outputs a minimum luminance pixel number information value Ni-min. Also, on the basis of the histogram generated by the histogram generating block 111*y*, the average luminance detecting block 115*y* calculates an average luminance gray-level information value about the one frame of image signal Db, and outputs it as a luminance signal average gray-level information value Yi-ave.

Figure 16:
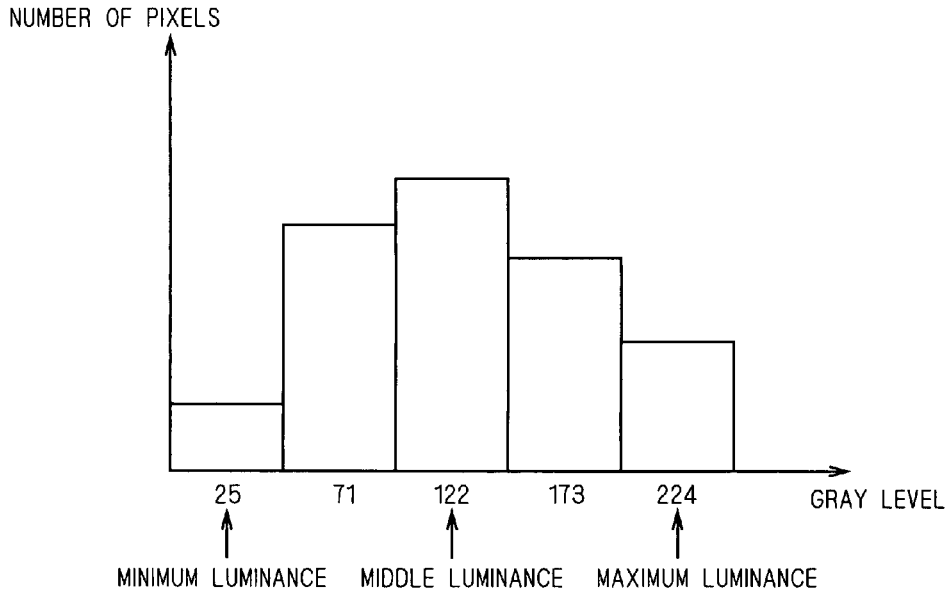
FIG. 16 is a diagram illustrating evenly divided luminance information conditions generated in a histogram generating block of the second preferred embodiment of the present invention.

FIG. 16 is a diagram showing an example of the histogram generated by the histogram generating block 111*y*. In the diagram, the horizontal axis shows gray level values (classes), and the vertical axis shows frequencies, i.e., the numbers of pixels with respect to the luminance of one frame of the image signal Db. In the description below, the luminance signal Y of the image signal Db is formed of, e.g., 8-bit data, and the gray level values take values from "0" to "255" and the number of gray levels is "256".

For example, the histogram generating block 111*y* of the second preferred embodiment divides the 256 gray levels into 5 ranges each including 51 gray levels, where the 5 ranges correspond to the classes in the histogram. That is, the number of maximum luminance pixels is calculated from the class ranging from a first gray level value "204" to the maximum gray level value "255", the number of minimum luminance pixels is calculated from the class ranging from the minimum gray level value "0" to a second gray level value "50", and the number of middle luminance pixels is calculated from the class ranging from a third gray level value "102" to a fourth gray level value "152". In this process, a value in the vicinity of the center value in each class, or an integer closest to and larger than the center value in this example, is adopted as the representative value of that class. For example, in the class from gray level "0" to "50", the center value is "24.5", and so the representative value of this class is "25". The figures on the horizontal axis in FIG. 16 show the representative values of the individual classes. In this example, the gray levels are divided into five classes, and the minimum gray level 25 corresponds to the minimum luminance, the middle gray level 122 corresponds to the middle luminance, and the maximum gray level 224 corresponds to the maximum luminance.

Unlike the histogram shown in FIG. 16, the histogram may be divided into ranges other than five. For example, the histogram may be divided into three or seven, to form three or seven ranges. It is then possible to detect the feature more finely.

In the histogram generated as above, the maximum luminance pixel number detecting block 112*n* extracts the number of pixels in the class of maximum value, or a pixel number information value corresponding to the number of pixels. The maximum luminance pixel number detecting block 112*n* then outputs the extracted pixel number information value as the maximum luminance pixel number information value Ni-max.

Also, in the histogram generated as above, the middle luminance pixel number detecting block 113*n* extracts the number of pixels in the class of middle value, or a pixel number information value corresponding to the number of pixels. The middle luminance pixel number detecting block 113*n* then outputs the extracted pixel number information value as the middle luminance pixel number information value Ni-mid.

Also, in the histogram generated as above, the minimum luminance pixel number detecting block 114*n* extracts the number of pixels in the class of minimum value, or a pixel number information value corresponding to the number of pixels. The minimum luminance pixel number detecting block 114*n* then outputs the extracted pixel number information value as the minimum luminance pixel number information value Ni-min.

Also, from the luminance signal Dby obtained from the one frame of image signal Db, the average luminance detecting block 115*y* calculates and outputs an average gray-level information value Yi-ave about the one frame of luminance signal Dby. This operation is the same as that of the average luminance gray-level detecting block 95*y* of the first preferred embodiment, and so not described here again.

Figure 17:
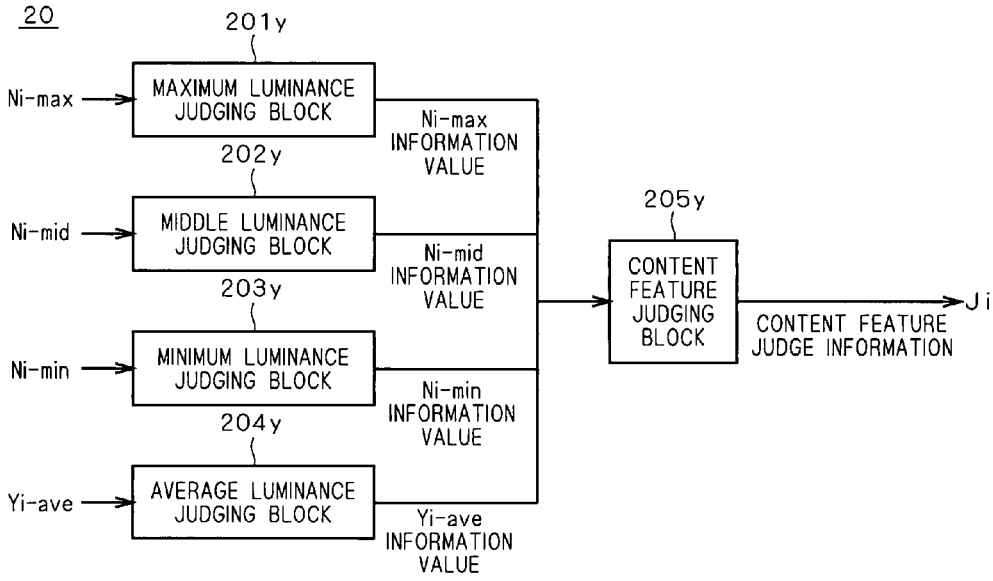
FIG. 17 is a block diagram illustrating a content feature detecting block of the second preferred embodiment of the present invention.

FIG. 17 is a block diagram illustrating the detailed configuration of the content feature detecting block 20. As shown in FIG. 17, the content feature detecting block 20 of the second preferred embodiment includes a maximum luminance judging block 201*y*, a middle luminance judging block 202*y*, a minimum luminance judging block 203*y*, an average luminance judging block 204*y*, and a content feature judging block 205*y*.

The maximum luminance pixel number information value Ni-max outputted from the luminance information detecting block is inputted to the maximum luminance judging block 201*y*, the middle luminance pixel number information value Ni-mid is inputted to the middle luminance judging block 202*y*, the minimum luminance pixel number information value Ni-min is inputted to the minimum luminance judging block 203*y*, and the average gray-level information value Yi-ave is inputted to the average luminance judging block 204*y*.

On the basis of the maximum luminance pixel number information value Ni-max, the maximum luminance judging block 201*y* categorizes the value of the number of maximum luminance pixels and generates a category information as Ni-max information value. The middle luminance judging block 202*y* categorizes the value of the number of middle luminance pixels from the middle luminance pixel number information value Ni-mid, and generates a category information as Ni-mid information value. The minimum luminance judging block 203*y* categorizes the value of the number of minimum luminance pixels from the minimum luminance pixel number information value Ni-min, and generates a category information as Ni-min information value. The average luminance judging block 204*y* categorizes the magnitude of the average luminance from the average gray-level information value Yi-ave, and generates a category information as Yi-ave information value.

Figure 18:
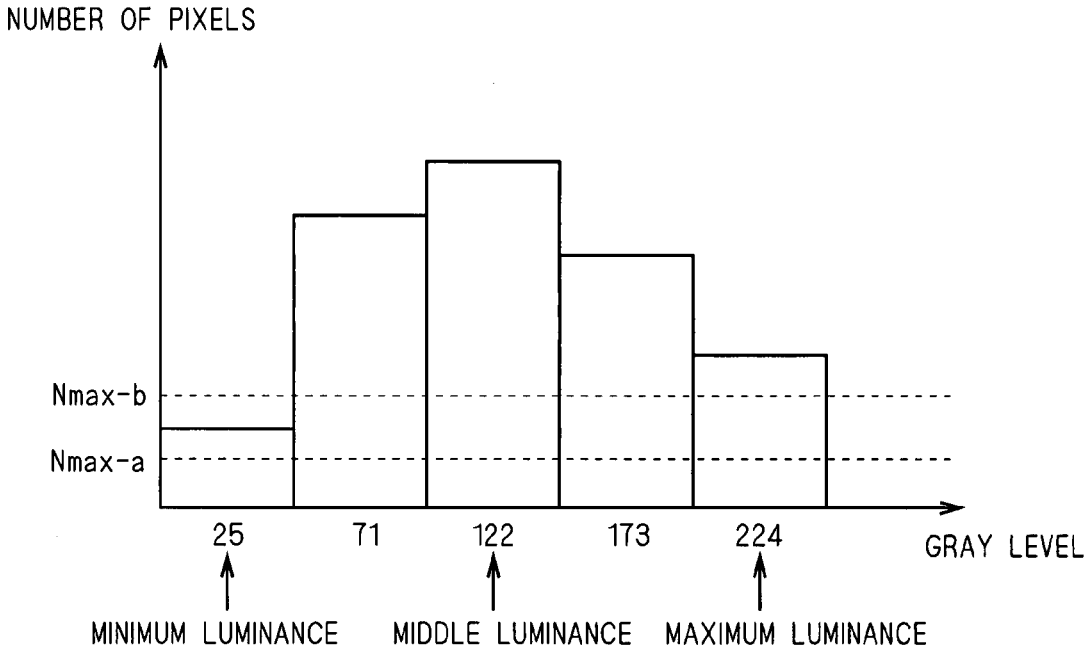
FIG. 18 is a diagram illustrating a threshold condition for maximum luminance information in the second preferred embodiment of the present invention.

Specifically, as shown in FIG. 18, the maximum luminance judging block 201*y* checks whether the maximum luminance pixel number information value Ni-max is smaller than a given maximum luminance pixel number judge threshold Nmax-a, or between the given threshold Nmax-a and a larger given threshold Nmax-b, or larger than the maximum luminance pixel number judge threshold Nmax-b, and outputs one of three category information values Ni-max-small, Ni-max-middle, and Ni-max-large, which is inputted to the content feature judging block 205*y*. More specifically, in the example of FIG. 18, the value is larger than the given threshold Nmax-b, and so the information value Ni-max-large is outputted to the content feature judging block 205*y*.

Figure 19:
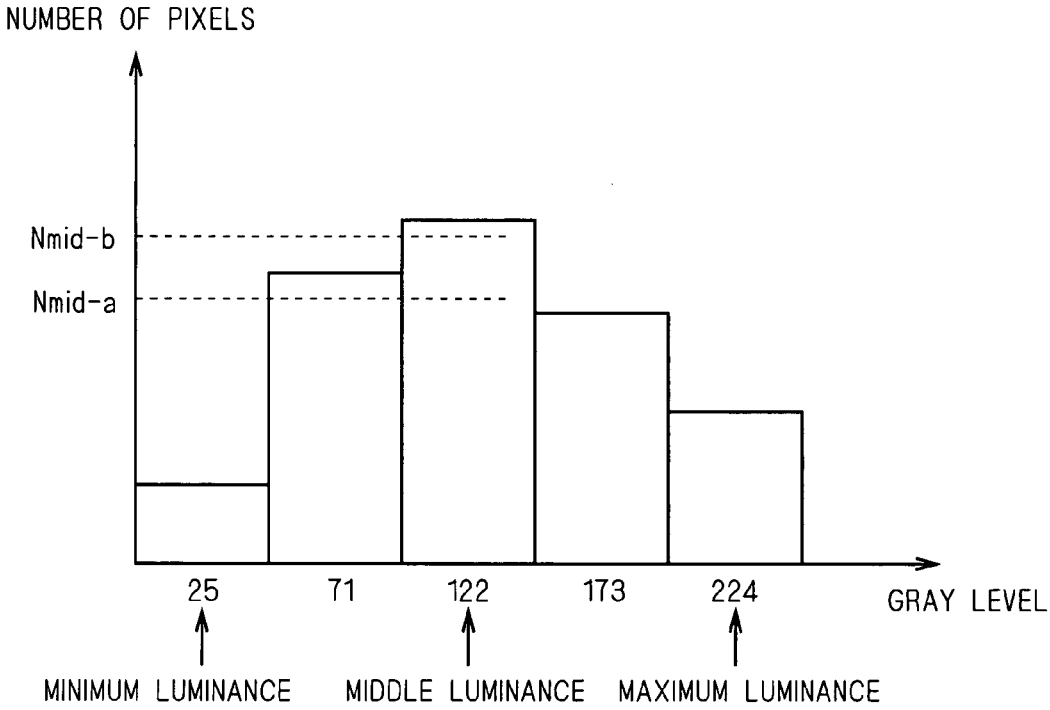
FIG. 19 is a diagram illustrating a threshold condition for middle luminance information in the second preferred embodiment of the present invention.

Also, as shown in FIG. 19, the middle luminance judging block 202*y* checks whether the middle luminance pixel number information value Ni-mid is smaller than a given middle luminance pixel number judge threshold Nmid-a, or between the given threshold Nmid-a and a larger given threshold Nmid-b, or larger than the middle luminance pixel number judge threshold Nmid-b, and outputs one of three category information values Ni-mid-small, Ni-mid-middle, and Ni-mid-large, which is inputted to the content feature judging block 205*y*. More specifically, in the example of FIG. 19, the value is larger than the given threshold Nmid-b, and so the information value Ni-mid-large is outputted to the content feature judging block 205*y*.

Figure 20:
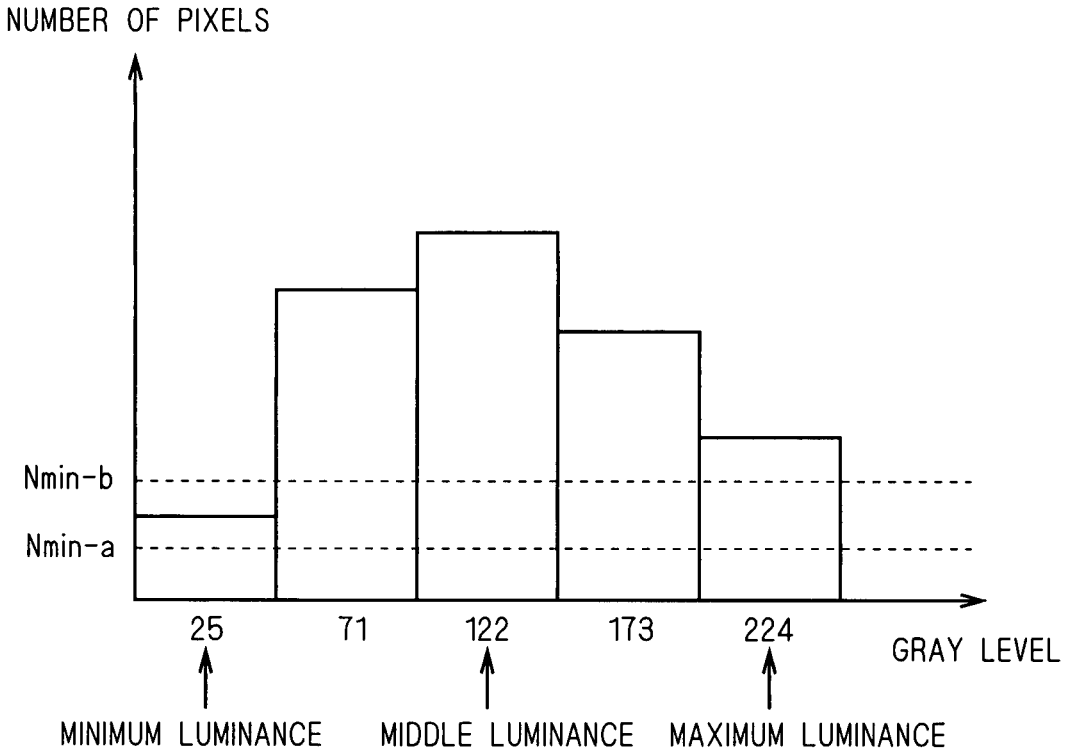
FIG. 20 is a diagram illustrating a threshold condition for minimum luminance information in the second preferred embodiment of the present invention.

Also, as shown in FIG. 20, the minimum luminance judging block 203*y* checks whether the minimum luminance pixel number information value Ni-min is smaller than a given minimum luminance pixel number judge threshold Nmin-a, or between the given threshold Nmin-a and a larger given threshold Nmin-b, or larger than the minimum luminance pixel number judge threshold Nmin-b, and outputs one of three category information values Ni-min-small, Ni-min-middle, and Ni-min-large, which is inputted to the content feature judging block 205*y*. More specifically, in the example of FIG. 20, the value is between the given thresholds Nmin-a and Nmin-b, and so the information value Ni-min-middle is outputted to the content feature judging block 205*y*.

Also, the average luminance judging block 204*y* checks whether the average gray-level information value Yi-ave calculated according to Expression (1) is smaller than a given average luminance judge threshold Yave-a, or between the given threshold Yave-a and a larger given threshold Yave-b, or larger than the average luminance judge threshold Yave-b, and outputs one of three category information values Yi-ave-small, Yi-ave-middle, and Yi-ave-large, which is inputted to the content feature judging block 205*y*.

On the basis of the combination of the four luminance information values, the content feature judging block 205*y* judges the content feature according to a table of combinations as shown in FIG. 21. The content feature judging block outputs the content feature judge information value Ji to the image quality adjusting block 6. As mentioned in the first preferred embodiment, the table of combinations for judging the content feature can be arbitrarily created on the basis of the viewer's tastes or a video database. For example, when the average gray-level information value Yi-ave is small, the minimum luminance pixel number information value Ni-min is small, the middle luminance pixel number information value Ni-mid is small, and the maximum luminance pixel number information value Ni-max is small, then the content feature is judged to be the feature kind J1, which is outputted to the multiple content feature detecting block 11.

The content feature judging block 205*y* may make the judgment by using three or less of the four luminance information values. For example, information can be chosen such that the content feature is categorized with the average luminance information value alone, or with two values including the average luminance information value and the maximum luminance pixel number information value. By reducing the amount of information in this way, it is possible to increase the speed for detecting the feature and to reduce the amount of required memory capacity.

The multiple content feature detecting block 11 performs arithmetic operation on the basis of the inputted content feature judge information values Ji and obtains a multiple content feature information value Fi that reflects the content feature judge information values Ji about multiple frames, in the same that described in the thirst preferred embodiment.

On the basis of the inputted multiple content feature information value Fi, the image quality adjustment control block 4 selects a correction parameter Pi suitable for the content feature, and outputs it to the image quality adjustment carrying-out block 5. This control is the same as that described in the first preferred embodiment and so not described again here.

In this way, the image display apparatus of the second preferred embodiment applies image quality adjustment to the image signal Db on the basis of the content feature information determined from the maximum luminance pixel number information value, middle luminance pixel number information value, minimum luminance pixel number information value, and average luminance gray-level information value, whereby the image display apparatus is capable of performing most suitable image quality adjustment on the basis of the judgment of content feature obtained from the image signal Db.

In this example, making the content feature judgment by using the technique of Patent Document 2 requires identifying key frames for characterizing the content, and on the basis of the information, retaining frame numbers associated with the key frames throughout the procedure.

However, the image display apparatus of the second preferred embodiment is capable of determining the content feature in real time and applying most suitable image quality adjustment for each frame, by extracting the feature for each frame, determining the content feature, and applying image quality adjustment to the image signal Db.

Also, in the second preferred embodiment, certain luminance ranges in the gray-level histogram are used for the maximum luminance information value, the minimum luminance information value, and the middle luminance information value about that image signal. Also, luminance pixel number judge thresholds are set for the individual luminance values. Accordingly, it is possible to perform fine and user-adaptable image quality adjustment by adjusting the thresholds.

Third Preferred Embodiment

Figure 22:
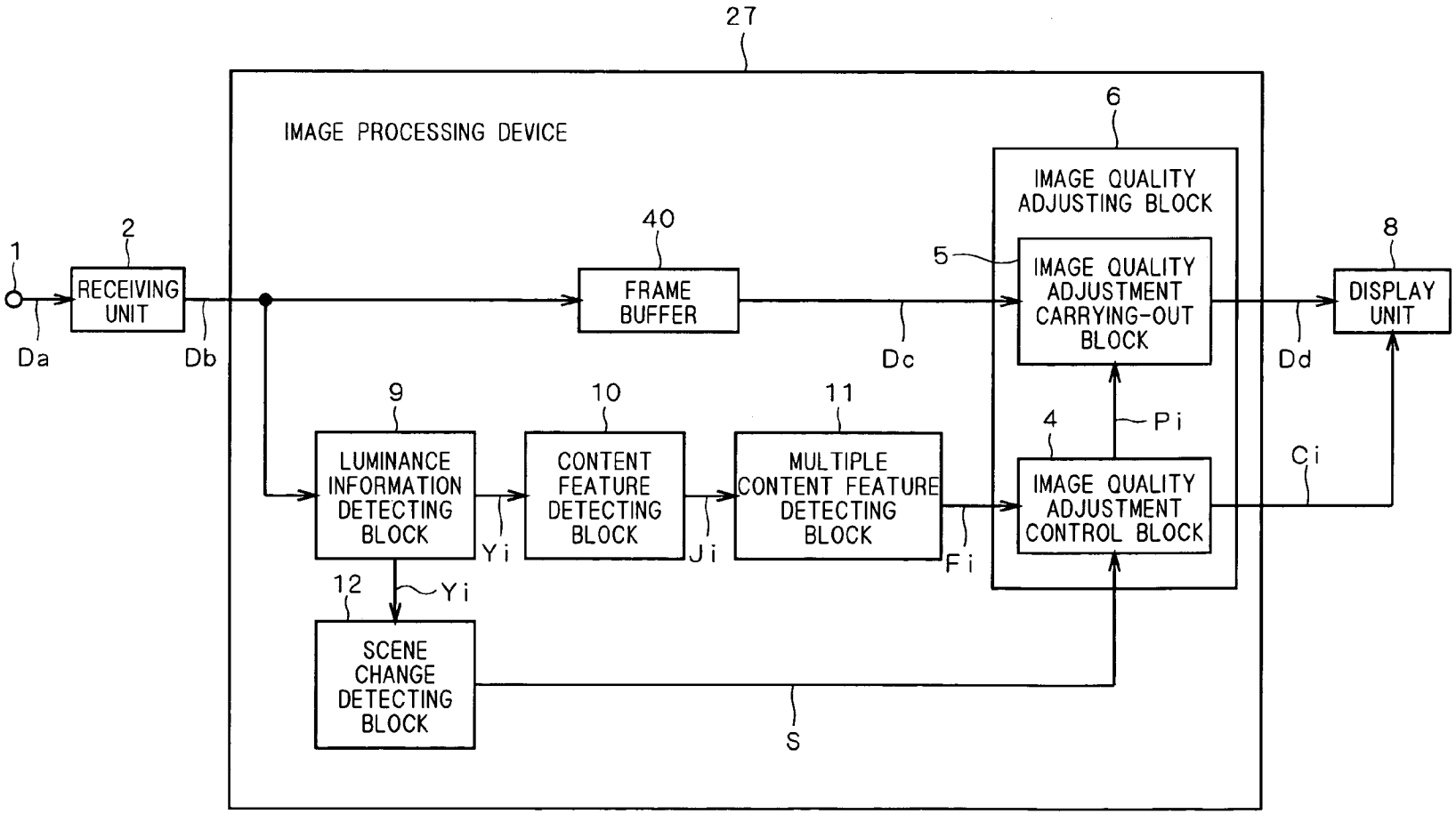
FIG. 22 is a block diagram illustrating the configuration of an image display apparatus according to a third preferred embodiment of the present invention.

FIG. 22 is a block diagram illustrating the configuration of an image display apparatus according to a third preferred embodiment of the present invention. The image display apparatus of the third preferred embodiment includes an input terminal 1, a receiving unit 2, an image processing device 27, and a display unit 8.

The input terminal 1 and the receiving unit 2 are the same as those of the first preferred embodiment and so not described here again.

The image processing device 27 includes a luminance information detecting block 9, a content feature detecting block 10, a multiple content feature detecting block 11, an image quality adjustment carrying-out block 5, an image quality adjustment control block 4, a frame buffer 40, and a scene change detecting block 12. An image signal Db outputted from the receiving unit 2 is inputted to the luminance information detecting block 9 and also to the frame buffer 40 of the video display device 3.

The luminance information detecting block 9 and the content feature detecting block 10 can be the luminance information detecting block 19 and the content feature detecting block 20 used in the second preferred embodiment.

The frame buffer 40 stores and delays one frame or multiple frames of the image signal Db in the memory, and outputs it as an image (video) signal Dc to the image quality adjustment carrying-out block 5.

The luminance information detecting block 9 detects a luminance information value Yi from the luminance of individual pixels in one frame or multiple frames of a luminance signal Y contained in the input image signal Db. The luminance information detecting block 9 outputs the luminance information value Yi to the content feature detecting block 10 and also to the scene change detecting block 12.

The content feature detecting block 10 judges the feature of the video content on the basis of the luminance information value Yi, and outputs a content feature judge information value Ji to the multiple content feature detecting block 11.

On the basis of the content feature judge information values Ji about multiple frames, the multiple content feature detecting block 11 determines most likely, least variable video content, and outputs the multiple content feature information value Fi to the image quality adjustment control block 4.

The scene change detecting block 12 detects a scene change on the basis of the luminance information value Yi (scene change detecting information) outputted from the luminance information detecting block 9, and outputs a scene change detect value S to the image quality adjustment control block 4 when a scene change takes place.

The image quality adjustment control block 4 selects a correction parameter Pi suitable for the content feature based on the multiple content feature information value Fi, and outputs the correction parameter Pi to the image quality adjustment carrying-out bock 5 according to the timing of the scene change detect value S. Also, according to the timing of the scene change detect value S, the image quality adjustment control block 4 outputs, to the display unit 8, a display unit control value Ci suitable for the multiple content feature information value Fi.

The image quality adjustment carrying-out block 5 applies image quality adjustment to the image signal Dc by using the inputted (video) correction parameter Pi, and outputs it as an image (video) signal Dd to the display unit 8.

The display unit 8 displays the image on the basis of the inputted image signal Dd. Also, the display unit 8 controls the display on the basis of the display unit control value Ci. The display unit 8 is the same as those of the first and second preferred embodiments, and so not described again here.

It is desired that the multiple content feature detecting block 11 promptly output the multiple content feature information value Fi so that the following image quality adjustment processing can be finished in the video blanking period. That is, the computing operation is finished in the video blanking period after the video effective period, before the next frame is started, and the multiple content feature information value Fi is promptly outputted.

For the initial output value of the multiple content feature detecting block 11 about the first frame of the input image, the content feature judge information value Ji from the content feature detecting block 10, which is determined about one frame, can be used as the multiple content feature information value Fi, because the judgment will be unstable in the absence of input information about multiple frames.

According to the multiple content feature detecting block 11 of the third preferred embodiment, even when the content drastically changes only in a certain single frame in the same genre, the judgment indicated by the content feature judge information value Ji about that frame is automatically removed during the analysis by the multiple content feature detecting block 11, which prevents extreme image quality correction from being applied. That is, when the video content changes for each frame, for example, the multiple content feature detecting block 11 prevents the image quality from being changed for each frame, thus preventing the image from becoming unnatural.

The multiple content feature detecting block 11 is applicable not only to image display apparatuses but also to other fields related to video, as a method for more accurately judging the amount of feature of video content from luminance information value. For example, it can be applied to other fields like video recording apparatuses, such as video recorders for hard discs, DVDs, and the like.

As to the multiple content feature detecting block 11, the content feature judge information value Ji based on a judgment about one frame only may be outputted as the multiple content feature information value Fi, without a judgment made about multiple frames. That is, the content feature may be detected only about a single frame, and then the multiple content feature detecting block 11 can be omitted. In this case, the content feature judge information value Ji outputted from the content feature detecting block 10 is outputted as Fi to the image quality adjustment control block 4. In this case, the content feature is judged for each frame and the image quality correction is applied for each frame, which enables most suitable image quality correction applied in real time.

The image quality adjustment control block 4 selects a the correction parameter Pi adjusted to the feature of the content on the basis of the multiple content feature information value Fi, and outputs it to the image quality adjustment carrying-out block 5 according to the timing of the scene change detect value S. Also, according to the timing of the scene change detect value S, the image quality adjustment control block 4 outputs, to the display unit 8, the display unit control value Ci adjusted to the multiple content feature information value Fi. Even when the multiple content feature information value Fi changes, the image quality adjustment control block 4 does not output the correction parameter Pi and the display unit control value Ci until the scene change detect value S is inputted.

The judgment about the content takes time because the multiple content feature information value Fi is determined on the basis of information about multiple frames. Accordingly, the time when the judgment is made may not match with the scene change of the content. If the image quality suddenly changes in the course of consecutive scenes, the viewer will feel it unnatural. However, the image quality adjustment control block 4 applies image quality correction at the time when a scene change is detected, i.e., during the scene change, and so the viewer will not feel the change of image quality unnatural.

It is desired that, when the scene change detect value S is inputted, the image quality adjusting block 6 output the correction parameter Pi and the display unit control value Ci during the video blanking period so that the image quality correction can be finished before the video of the next frame starts.

FIG. 23 shows an example of output control values from the image quality adjustment control block 4, with respect to multiple content feature judge values F1 to F5 that are categorized into five genres. The content features are judged on the basis of the luminance information and categorized into genres. Then, when the video content is thus categorized into genres, not only luminance but also other components can be freely adjusted on the basis of the genres' tendencies and characteristics, so as to conform to the user's tastes and system.

The correction parameter Pi outputted from the image quality adjustment control block 4 to the image quality adjustment carrying-out block 5 according to the multiple content feature information value Fi can be provided to achieve luminance control based on video contrast, sharpness control, color density control, noise reduction control based on three-dimensional (3D) noise reduction, luminance correction based on gamma correction, and so on. Also, in the case of a liquid-crystal display, the display unit control value Ci outputted from the image quality adjustment control block 4 to the display unit 8 can be provided to achieve moving picture response improvement by overdrive, luminance control by backlight, and so on. Also, though not described with the image display apparatus of this preferred embodiment, audio may also be corrected according to the content feature and genre in the case of a television receiver. etc. having audio output.

FIG. 23 shows an example of settings for image quality with respect to the multiple content judge values Fi. In Sports (F1), the luminance will include more halftones and will be evenly spread at all levels, and so the gamma correction is set flat, contrast is set medium, backlight medium, and sharpness is set low because it is a natural image, and color density is set medium, moving picture response improvement for a liquid-crystal panel is set high because sports video will contain rapid motions, and 3D noise reduction is set low because it might leave traces in moving pictures. In Music (F2), it is desirable to make the video colorful with brightness and darkness, and so contrast is set high, gamma correction is set to lift black and white sides, backlight high, color density high, overdrive high, sharpness medium because people will be the main objects, and 3D noise reduction is set medium. In Studio (F3), the average luminance will be high and the picture will be bright, and so gamma correction is set to stretch white side, luminance is somewhat suppressed because excessive brightness will tax viewer's eyes, contrast is set low, backlight medium, color density medium, and sharpness is set high because it will mainly include news or data images, 3D noise reduction is set high because the source will not have very good SN, and overdrive is set medium because motion will be normal. In Movie (F4), it will contain more darker scenes, and so contrast is set high, gamma correction is set to stretch black side, backlight is set low in order to darken the luminance on the black side to enhance contrast, sharpness is set low to obtain restful pictures suitable for movies, color density is low, 3D noise reduction is low because movies often contain intentional noise, and overdrive is set medium because motion will be normal. In Drama and Animation, contrast is set high because luminance will be low, gamma correction is set to lift halftones, backlight is set medium, sharpness is set medium because animations will contain a lot of contours, color density is set high because animations will contain more primary colors, overdrive is set low because it will contain less motions, and 3D noise reduction is set medium because dramas will contain medium noise. The settings for image quality above are shown just by way of example, and the settings can be freely determined later according to user's tastes.

The settings for image quality, including contrast, sharpness, etc., can be configured such that the user can freely change the settings with a remote controller, operating keys, and the like. It may be configured such that the user can change the settings from previously set values according to the user's tastes and can recall the changed settings. In conventional apparatuses, with a movie program, for example, the user manually selects settings that the user previously set for movies, by operating buttons of a remote controller or an on-screen menu. In contrast, when the program is movie content, this preferred embodiment automatically selects image quality settings that the user previously set for movies, and thus offers most suitable image quality. Also, when the movie program ends and a bright, studio program like a TV variety show starts, it is necessary in conventional techniques to manually change the image quality to the settings for studio; otherwise the image quality would be made undesirable, white would be ruined, because the settings are still those suitable for dark images of movie. However, this preferred embodiment automatically switches to the image quality settings for studio, so as to display the video with suitable image quality.

When the category is determined according to the multiple content feature information value Fi, the category may be displayed on the screen by, e.g., on-screen display. For example, when the content feature is judged to be movie, "movie" may be displayed on the screen. Also, when image quality correction is effected according to the timing of a scene change detection, the category based on the multiple content feature information value Fi may be displayed.

The frame buffer 40 stores and delays one frame or multiple frames of the image signal Db, and outputs it as the image signal Dc to the image quality adjustment carrying-out block 5. The luminance information detecting block 9 of this preferred embodiment generates a histogram with accumulated values of video information about one frame or multiple frames. Accordingly, the luminance information detecting block 9 provides its output after a delay of some frames, and so it is desired that the frame buffer 40 generate a delay corresponding to the number of frames.

A signal processing circuit with a frame delay that is normally provided in a video display apparatus may be used as the frame buffer 40. Such a signal processing circuit with a frame delay can be an interlace-progressive (IP) conversion circuit, a frame rate conversion circuit, or a resizer circuit, for example. That is, when IP conversion involves a delay of one frame, the video signal that precedes the IP conversion circuit is inputted to the luminance information detecting block 9, and the image quality correction control based on the output of the image quality adjustment control block 4 is applied to the video correction circuit that follows the IP conversion circuit, whereby the frame buffer can be omitted and costs can be reduced.

When the multiple content feature detecting block 11 adopts the second method alone in which it checks sequentially inputted content feature judge information values Ji and determines the multiple content feature information value Fi when the same value consecutively achieves a given judge number M, then the multiple content feature information value Fi is always outputted after a given judge number M of frames, and so the image quality correction can be applied to the first frame that was judged to be that content, when the delay in the frame buffer is set to M+1 frames. The delay is set to be M+1 frames because the luminance information detecting block involves a delay of one frame. Also, the scene change detecting block 12 can be omitted because the first frame of the judgment is always the first frame that comes after the scene change, and the change of image quality is not noticeable because the correction is effected immediately after the scene change. When the multiple content feature detecting block 11 adopts the first method, the multiple content feature information value Fi is not outputted after a given number of frames. Also, in the third method, the image of K frames before does not always correspond to the judgment based on the multiple content feature information value Fi. When the first method or the third method is adopted, or when the first to third methods are used in combination, the frame buffer 40 can be set to generate a delay of one frame, for the accumulation for the histogram about one frame in the luminance information detecting block.

When the multiple content feature detecting block 11 is omitted and control is applied for each frame, the frame buffer 40 can be set to cause a delay of one frame so that the image quality correction based on the content feature judgment can be applied to the present frame, which enables real-time image quality correction. Also, the scene change detecting block 12 can be omitted because a change of the content feature judge information value Ji corresponds to a scene change.

The luminance information detecting block 9 generates a cumulative histogram about one frame, and so the result of detection delays one frame. Accordingly, the result of detection can be matched to the present video frame by delaying the input image signal Db by one frame in the frame buffer 40. Also, it is desirable to set a suitable delay in the frame buffer 40 so that the delay times of the multiple content feature information value Fi and the scene change detect S behind the video signal are compensated. Through the use of the frame buffer, the image quality correction based on content feature detection can be applied to the video signal without delay, which enables natural image quality correction.

The scene change detecting block 12 detects a scene change on the basis of the luminance information value Yi outputted from the luminance information detecting block 9, and outputs the scene change detect value S to the image quality adjustment control block 4 when a scene change takes place. For example, "0" is outputted as the scene change detect value S when no scene change takes place, and "1" is outputted for a given period of time when a scene change takes place. It is desirable to output the scene change detect value S as soon as possible, immediately after the video effective period ends.

Figure 24:
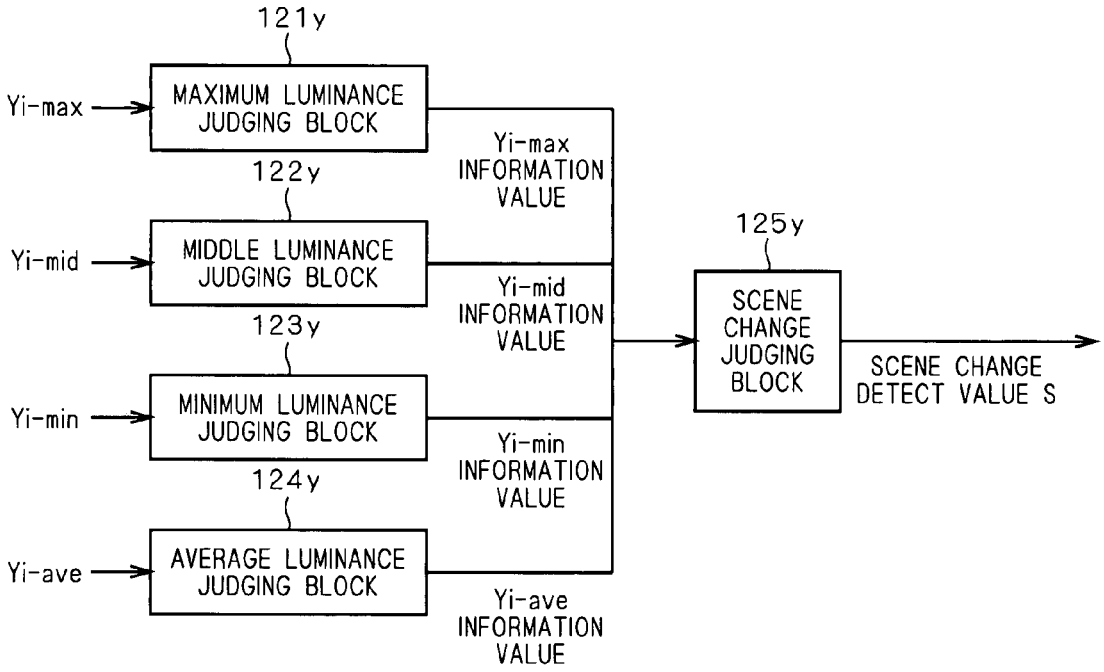
FIG. 24 is a block diagram illustrating the detailed configuration of a scene change detecting block 12.

FIG. 24 is a block diagram illustrating the detailed configuration of the scene change detecting block 12. As shown in FIG. 24, the scene change detecting block 12 includes a maximum luminance judging block 121*y*, a middle luminance judging block 122*y*, a minimum luminance judging block 123*y*, an average luminance judging block 124*y*, and a scene change judging block 125*y*.

A maximum gray-level information value Yi-max outputted from the luminance information detecting block 9 is inputted to the maximum luminance judging block 121*y*, a middle gray-level information value Yi-mid is inputted to the middle luminance judging block 122*y*, a minimum gray-level information value Yi-min is inputted to the minimum luminance judging block 123*y*, and an average gray-level information value Yi-ave is inputted to the average luminance judging block 124*y*.

On the basis of the maximum gray-level information value Yi-max, the maximum luminance judging block 121*y* categorizes the magnitude of the maximum luminance and generates the maximum gray-level information value Yi-max as a maximum luminance information value. The middle luminance judging block 122*y* categorizes the magnitude of the middle luminance from the middle gray-level information value Yi-mid, and generates the middle gray-level information value Yi-mid as a middle luminance information value. The minimum luminance judging block 123*y* categorizes the magnitude of the minimum luminance from the minimum gray-level information value Yi-min, and generates the minimum gray-level information value Yi-min as a minimum luminance information value. The average luminance judging block 124*y* categorizes the magnitude of the average luminance from the average gray-level information value Yi-ave, and generates the average gray-level information value Yi-ave as an average luminance information value.

The maximum luminance judging block 121*y* checks whether the maximum gray-level information value Yi-max is smaller than a given maximum luminance judge threshold Ymax-a, or between the given threshold Ymax-a and a larger given threshold Ymax-b, or larger than the maximum luminance judge threshold Ymax-b, and outputs one of three category information values Yi-max-small, Yi-max-middle, and Yi-max-large, which is inputted to the scene change judging block 125*y*.

Also, the middle luminance judging block 122*y* checks whether the middle gray-level information value Yi-mid is smaller than a given middle luminance judge threshold Ymid-a, or between the given threshold Ymid-a and a larger given threshold Ymid-b, or larger than the middle luminance judge threshold Ymid-b, and outputs one of three category information values Yi-mid-small, Yi-mid-middle, and Yi-mid-large, which is inputted to the scene change judging block 125*y*.

Also, the minimum luminance judging block 123*y* checks whether the minimum gray-level information value Yi-min is smaller than a given minimum luminance judge threshold Ymin-a, or between the given threshold Ymin-a and a larger given threshold Ymin-b, or larger than the minimum luminance judge threshold Ymin-b, and outputs one of three category information values Yi-min-small, Yi-min-middle, and Yi-min-large, which is inputted to the scene change judging block 125*y*.

Also, the average luminance judging block 124*y* checks whether the average gray-level information value Yi-ave calculated according to Expression (1) is smaller than a given average luminance judge threshold Yave-a, or between the given threshold Yave-a and a larger given threshold Yave-b, or larger than the average luminance judge threshold Yave-b, and outputs one of three category information values Yi-ave-small, Yi-ave-middle, and Yi-ave-large, which is inputted to the scene change judging block 125*y*.

The scene change judging block 125*y* determines a scene change on the basis of the combination of the four luminance information values, including three states of small, middle and large. As shown in FIG. 25, there are 3×3×3×3=81 combinations in this preferred embodiment. According to the table of combinations, the scene change judging block 125*y* compares the present state Si and the state Si-1 of the previous frame, and detects a scene change and outputs the scene change detect value S when one or some of the large-, middle-, and small-states of the luminance information values change.

A change to a totally black scene (Yi-ave: small, Yi-min: small, Yi-mid: small, Yi-max: small) or a change to a totally white scene (Yi-ave: large, Yi-min: large, Yi-mid: large, Yi-max: large) may be regarded as a scene change. In particular, a change by the image quality correction is almost unnoticeable when it is applied to a totally black scene.

When the combination of luminance information values Si after a scene change is categorized into the same content as the present multiple content feature information value Fi, it is regarded as a scene change in the same content category, and the same image quality correction is applied, and so it is not necessary to output the scene change detect value S to the image quality adjustment control block 4. However, even when the combination of luminance information values Si after a scene change is categorized as the same content as the present multiple content feature information value Fi, the scene change detect value S is outputted if the image quality correction is not being performed according to that multiple content feature information value Fi.

In order to complete the following image quality correction processing within the video blanking period, it is desired that the scene change detecting block 12 promptly output the scene change detect value S in the video blanking period or immediately after the video blanking period ends. That is, it is desired that the scene change detect value S be outputted to the image quality adjustment control block 4 within the video blanking period during the scene change and the image quality correction be completed within the video blanking period.

The scene change judging block 125*y* may make the judgment by using three or less of the four luminance information values. For example, it may judge a scene change on the basis of the average luminance information value alone. Also, the luminance judge values in this example are classified into three states including large, middle, and small, but they may be classified into other numbers of states. Real values may be used for comparison, in place of the large, middle, and small states.

Figure 26:
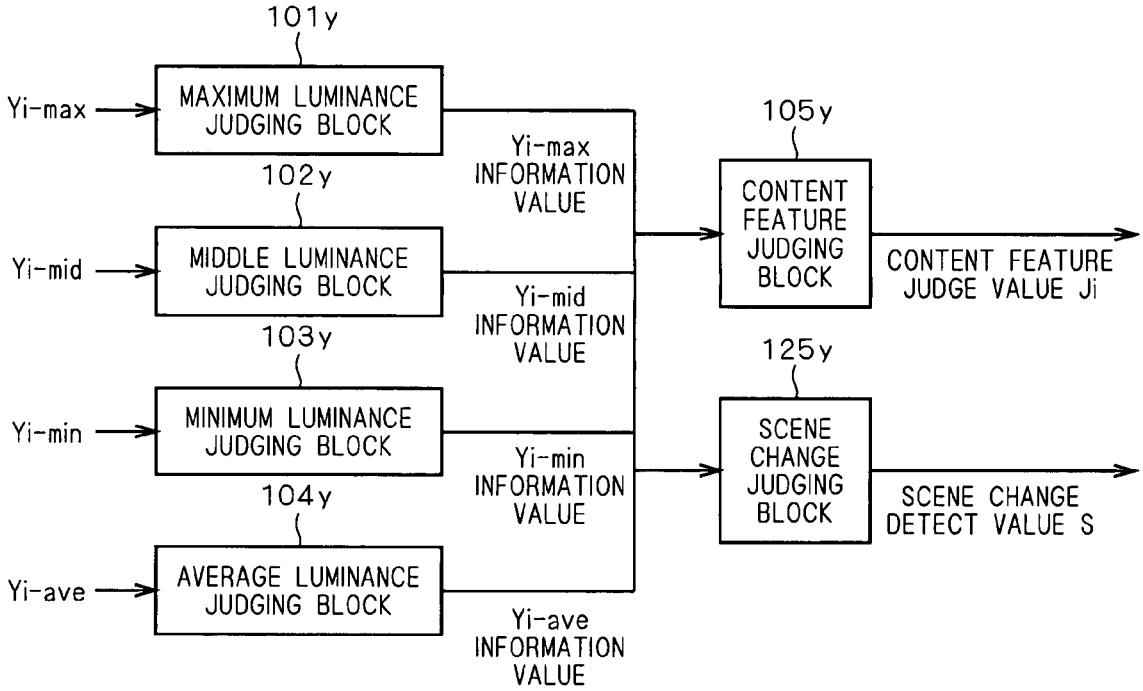
FIG. 26 is a block diagram of a scene change judging block 125*y* incorporated in a content feature detecting block 10.

The configurations of the maximum luminance judging block 121*y*, the middle luminance judging block 122*y*, the minimum luminance judging block 123*y*, and the average luminance judging block 124*y* of the scene change detecting block 12 are the same as those of the maximum luminance judging block 101*y*, the middle luminance judging block 102*y*, the minimum luminance judging block 103*y*, and the average luminance judging block 104*y* of the content feature detecting block 10, and therefore the scene change detecting block 12 may be omitted, in which case, as shown in FIG. 26, the scene change judging block 125*y* may be incorporated in the content feature detecting block 10 to share the maximum luminance judging block 101*y*, the middle luminance judging block 102*y*, the minimum luminance judging block 103*y*, and the average luminance judging block 104*y*. The luminance judging blocks can thus be shared to reduce system costs.

Figure 27:
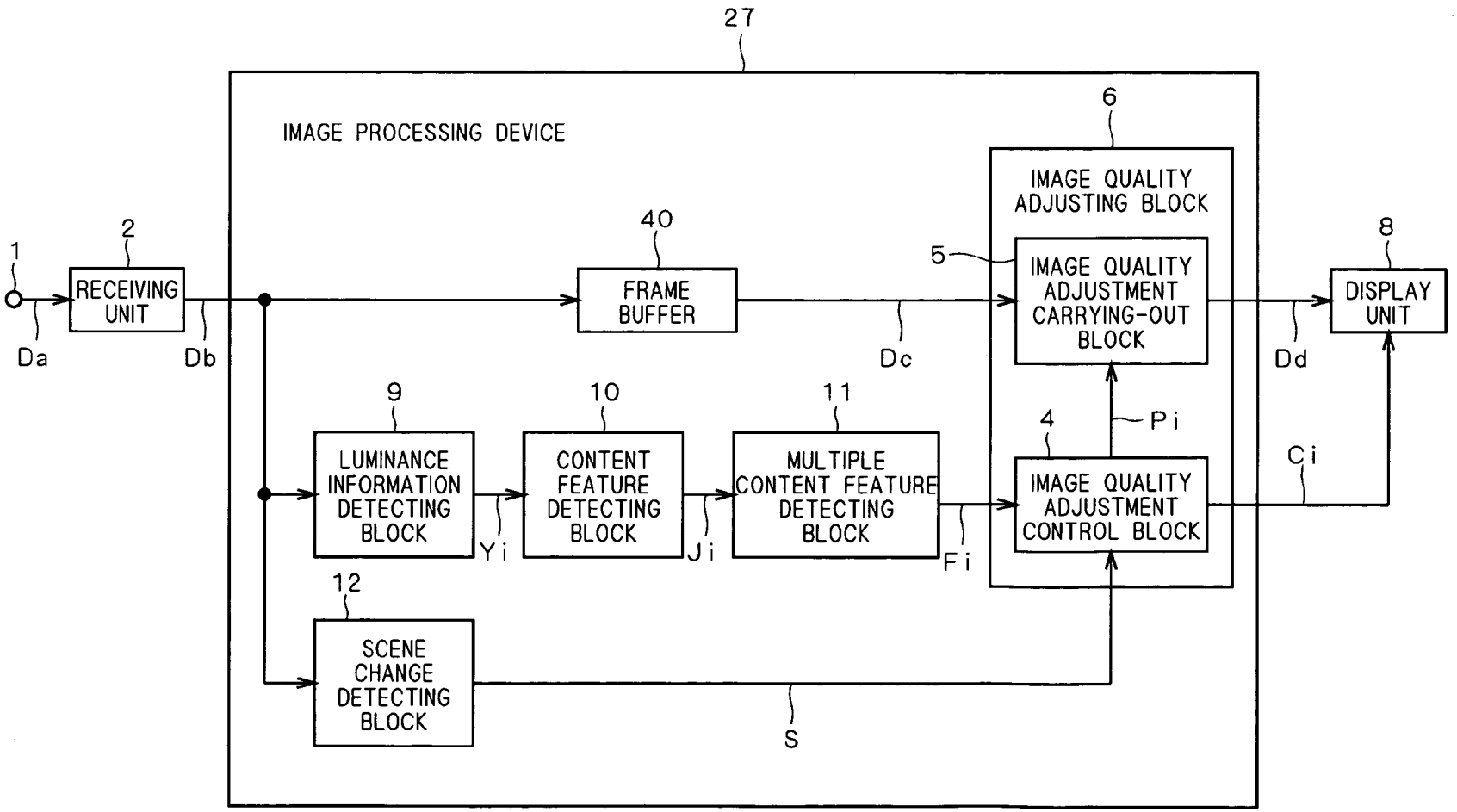
FIG. 27 is a block diagram illustrating a configuration in which the scene change detecting block 12 receives an image signal Db as its input.

As shown in the block diagram of FIG. 27, the image signal Db can be inputted to the scene change detecting block 12. In this case, scene changes can be detected by a known method. For example, one frame of video effective period is divided into M×N blocks, and average luminance YSmn(i) is calculated about each block and compared with average luminance YSmn(i-1) of each block of the previous frame. Then, the number V of blocks in which the difference YSmn(i)-YSmn (i-1) exceeds U is obtained, and a scene change is detected and the scene change detect value S is outputted when the number V of blocks exceeds half, or exceeds a threshold W. Also, when a known circuit such as an IP conversion circuit or a signal processing circuit has a scene change detection, the scene change detection value can be used. Also, the scene change detecting method of Patent Document 3 may be adopted.

Thus, the scene change detecting block 12 detects a scene change, and the image quality adjustment carrying-out block 5 and the display unit 8 are controlled according to the timing of the scene change, and the image quality correction is performed within the video blanking period during the scene change, whereby the change of image quality is achieved unnoticeably.

As described so far, the image display apparatus of the third preferred embodiment obtains gray-level information values from a cumulative histogram about luminance information in one frame of the input image signal Db, and judges the feature and genre of the content on the basis of information about multiple frames, whereby the content feature and genre of the input image signal Db can be accurately determined. Also, the frame buffer corrects the delay caused by judgment, the scene change detecting block 12 detects a scene change on the basis of the luminance gray-level information values, and the image quality correction is applied to the display unit 8 according to the timing of the scene change detection, whereby the image quality correction can be switched naturally. Also, it is possible to apply image quality correction that is most suitable for the content feature and genre, since the image quality correction is performed on the basis of the content feature judge value determined from the input image signal Db. Also, since the content feature and genre can be determined, not only luminance correction but also corrections of color, sharpness, moving picture response, and device control are possible. Furthermore, though not shown with the image display apparatus of the preferred embodiment, it is also possible to correct audio according to the content feature and genre in the case of a television receiver etc. having audio output.

Patent Document 1 cannot deal with real-time changes of video content within the same genre, but this preferred embodiment can deal with real-time changes of video content within the same genre. For example, when a genre "movie" is transmitted by digital broadcasting, the technique of Patent Document 1 performs image quality correction for "movie", and the image quality correction for "movie" is applied also to commercials during the program. In contrast, adopting the preferred embodiment allows the movie to undergo image quality correction suitable for movies, and commercials to undergo image quality correction suitable for commercials. Also, in the case of a "movie" on the theme of sports, for example, the technique of Patent Document 1 regards its genre as "movie", but the content feature detection of this preferred embodiment categorizes its genre as "sports". The discrepancy between the video content and the transmitted genre information is thus solved, enabling image quality correction suitable for the video content, or suitable for sports video that tends to be bright. Such genre information in digital broadcasting as described in Patent Document 1 may be used in combination, as initial values for the judgment, or for the purpose of enhancing the accuracy of the judgment of genre.

When the content feature is judged as described in this preferred embodiment by using the technique of Patent Document 2, it is necessary to identify key frames for characterizing the content, and on the basis of the information, to retain frame numbers associated with the key frames throughout the procedure. However, the image display apparatus of this preferred embodiment is capable of determining the content feature in real time and applying most suitable image quality adjustment, by extracting the feature of each frame, judging the content feature or genre by analyzing information about one frame or multiple frames, and applying image quality correction to the input video signal.

Patent Document 3 does not judge the content feature and genre of video signal. By adopting this preferred embodiment, the content feature and genre can be determined only with luminance information about the input video signal, and the image quality correction can be applied not only to luminance but also to various components, such as color, sharpness, moving picture response, device control, in a manner suitable for the content feature and genre.

Fourth Preferred Embodiment

Figure 28:
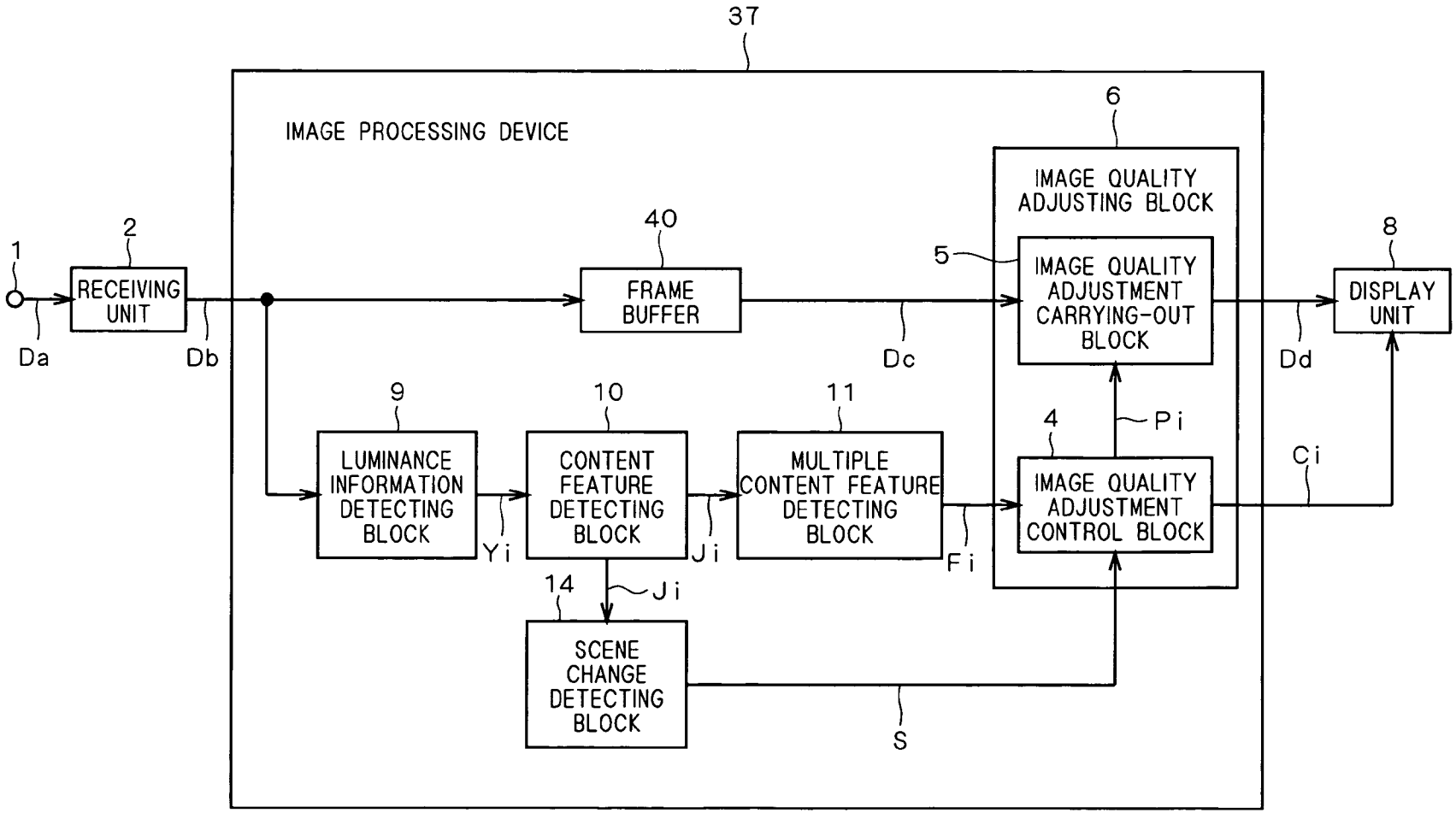
FIG. 28 is a block diagram illustrating the configuration of an image display apparatus according to a fourth preferred embodiment of the present invention.

FIG. 28 is a block diagram illustrating the configuration of an image display apparatus according to a fourth preferred embodiment of the present invention. The image display apparatus of the fourth preferred embodiment includes an image processing device 37 in place of the image processing device 27 of the third preferred embodiment.

The image processing device 37 of the fourth preferred embodiment includes a scene change detecting block 14, and the display unit 8, the image quality adjustment carrying-out block 5, the image quality adjustment control block 4, the frame buffer 40, the luminance information detecting block 9, the content feature detecting block 10, and the multiple content feature detecting block 11 of the third preferred embodiment.

An image signal Db outputted from the receiving unit 2 is inputted to the luminance information detecting block 9 and to the frame buffer 40 of the image processing device 37.

The frame buffer 40 stores and delays one frame or multiple frames of the image signal Db in the memory, and outputs it as an image signal Dc to the image quality adjustment carrying-out block 5.

The luminance information detecting block 9 receives input of a luminance signal Y contained in the image signal Db outputted from the receiving unit 2, and it detects luminance information about each pixel from the luminance signal Y about one frame, generates a histogram, and outputs a luminance information value Yi obtained from the histogram. The luminance information detecting block 9 outputs the luminance information value Yi to the content feature detecting block 10.

On the basis of the luminance information value Yi from the luminance information detecting block 9, the content feature detecting block 10 judges the feature of the one frame of video content, and outputs a content feature judge information value Ji to the multiple content feature detecting block 11, and also to the scene change detecting block 14.

On the basis of the content feature judge information values Ji about multiple frames, the multiple content feature detecting block 11 selects most likely, least variable video content, and outputs the multiple content feature information value Fi to the image quality adjustment control block 4.

The scene change detecting block 14 detects a scene change on the basis of the content feature judge information value Ji (scene change detecting information) outputted from the content feature detecting block 10, and outputs a scene change detect value S to the image quality adjustment control block 4 when a scene change takes place.

The image quality adjustment control block 4 selects a correction parameter Pi suitable for the content feature based on the multiple content feature information value Fi, and outputs the correction parameter Pi to the image quality adjustment carrying-out block 5 according to the timing of the scene change detect value S. Also, according to the timing of the scene change detect value S, the image quality adjustment control block 4 outputs, to the display unit 8, a display unit control value Ci based on the multiple content feature information value Fi.

The image quality adjustment carrying-out block 5 applies video correction to the image signal Dc by using the inputted correction parameter Pi, and outputs it as an image signal Dd to the display unit 8.

The display unit 8 displays video on the basis of the image signal Dd corrected in the image quality adjustment carrying-out block 5. Also, the display unit 8 controls the display on the basis of the display unit control value Ci.

In the fourth preferred embodiment, the display unit 8, the image quality adjustment carrying-out block 5, the image quality adjustment control block 4, the frame buffer 40, the luminance information detecting block 9, the content feature detecting block 10, and the multiple content feature detecting block 11 operate in exactly the same way as those described in the third preferred embodiment, and so their operations are not described in detail again here.

The input to the scene change detecting block 14 is the content feature judge information value Ji outputted from the content feature detecting block 10. A change of the content feature judge information value Ji corresponds to a change of the content, which is recognized as a scene change. That is, it compares the present state of the content feature judge information value Ji with the state Ji-1 of the previous frame, and outputs the scene change detect value S when the values differ.

In order to end the following image quality correction processing within the video blanking period, it is desired that the scene change detecting block 14 promptly output the scene change detect value S within the video blanking period. That is, it is desired that the scene change detect value S be outputted to the image quality adjustment control block 4 within the video blanking period during the scene change, and the image quality correction be ended within the video blanking period.

Thus, the scene change detecting block 14 detects a scene change, and the image quality adjustment control block 4 controls the image quality adjustment carrying-out block 5 and the display unit 8 according to the timing of the scene change, and the image quality is corrected within the video blanking period during the scene change, whereby the change of image quality is unnoticeable.

The configuration of the fourth preferred embodiment allows the judging section in the scene change detecting block to be configured simpler than that in the third preferred embodiment, which allows reduced system costs.

While the invention has been described in detail, the foregoing description is in all aspects illustrative and not restrictive. It is understood that numerous other modifications and variations can be devised without departing from the scope of the invention.

What is claimed is:

1. An image display apparatus comprising:

a luminance information detecting block that generates a histogram by using a luminance signal obtained from one frame of an image signal, and outputs a luminance-related information value from the histogram;

a feature judging block that determines a feature of video content of said one frame of the image signal on the basis of said luminance-related information value outputted from said luminance information detecting block to output a feature judge value;

a multiple feature judging block that analyzes multiple feature judge values outputted from said feature judging block over a plurality of frames to obtain a multiple feature judge value that represents a judged feature of video content for said plurality of frames; and a video correcting block that applies video correction to one frame of the image signal, on the basis of said multiple feature judge value.

2. The image display apparatus according to claim 1, wherein said multiple feature judging block counts kinds of the features indicated by said feature judge value that indicates a feature for each frame, and when said feature judge value indicates a same feature kind for a given number of times, said multiple feature judging block outputs said multiple feature judge value indicating that same feature kind.

3. The image display apparatus according to claim 1, wherein said multiple feature judging block counts kinds of the features indicated by said feature judge value that indicates a feature for each frame, and when said feature judge value indicates a same feature kind consecutively for a given number of times, said multiple feature judging block outputs said multiple feature judge value indicating that same feature kind.

4. The image display apparatus according to claim 1, wherein said multiple feature judging block counts, for a given number of frames, kinds of the features indicated by said feature judge value that indicates a feature for each frame, and said multiple feature judging block outputs said multiple feature judge value indicating a feature kind that appears with a largest frequency within said given number of frames.

5. The image display apparatus according to claim 1, further comprising:

a scene change detecting block that detects a scene change and obtains a scene change detect value on the basis of scene change detecting information including at least one of said luminance-related information value and said feature judge value;

a frame buffer that delays said image signal for one frame or multiple frames;

a correction control block that outputs a video correction value, and outputs a display unit control value, on the basis of said multiple feature judge value and said scene change detect value;

a video correction carrying-out block that applies video correction to said image signal delayed by said frame buffer, on the basis of said video correction value obtained from said correction control block; and a display unit that displays an image on the basis of said image signal outputted from said video correcting block and performs display control on the basis of said display unit control value, wherein said video correcting block includes said correction control block and said video correction carrying-out block.

6. The image display apparatus according to claim 5, wherein said frame buffer compensates for delays in said luminance information detecting block and said multiple feature judging block.

7. The image display apparatus according to claim 5, wherein said scene change detecting information includes said luminance-related information value, and said scene change detecting block and said feature judging block are configured by sharing a processing portion based on said luminance-related information value.

8. The image display apparatus according to claim 5, wherein said scene change detecting information includes said feature judge value.

9. The image display apparatus according to claim 5, wherein said correction control block performs image quality correction control in a blanking period during a scene change on the basis of said scene change detect value.

10. The image display apparatus according to claim 5, wherein said correction control block performs not only luminance correction but also a correction of said image signal and a control of said display unit on the basis of said multiple feature judge value obtained from said luminance signal.

11. An image display method comprising:

utilizing a processing device to perform a process including:

generating a histogram by using a luminance signal obtained from one frame of an image signal, and computing a luminance-related information value from the histogram;

determining a feature of video content of said one frame of the image signal on the basis of said luminance-related information value to compute a feature judge value;

analyzing multiple feature judge values computed over a plurality of frames to compute a multiple feature judge value that represents a judged feature of video content for said plurality of frames; and applying video correction to one frame of the image signal, on the basis of said multiple feature judge value.

12. The image display method according to claim 11, wherein the process further includes:

counting kinds of the features indicated by said feature judge value that indicates a feature for each frame, and when said feature judge value indicates a same feature kind for a given number of times, computing said multiple feature judge value to indicate that same feature kind.

13. The image display method according to claim 11, wherein the process further includes:

counting kinds of the features indicated by said feature judge value that indicates a feature for each frame, and when said feature judge value indicates a same feature kind consecutively for a given number of times, computing said multiple feature judge value to indicate that same feature kind.

14. The image display method according to claim 11, wherein the process further includes:

counting, for a given number of frames, kinds of the features indicated by said feature judge value that indicates a feature for each frame, and computing said multiple feature judge value to indicate a feature kind that appears with a largest frequency within said given number of frames.

15. The image display method according to claim 11, wherein the process further includes:

detecting a scene change and obtaining a scene change detect value on the basis of scene change detecting information including at least one of said luminance-related information value and said feature judge value;

utilizing a frame buffer to delay said image signal for one frame or multiple frames;

computing a video correction value and a display unit control value, on the basis of said multiple feature judge value and said scene change detect value;

applying video correction to said image signal delayed by said frame buffer, on the basis of said video correction value; and displaying an image on the basis of said image signal to which video correction is applied, and performing display control on the basis of said display unit control value.

16. The image display method according to claim 15, wherein said frame buffer compensates for delays in computing the luminance-related information value and the multiple feature judge value.

17. The image display method according to claim 15, wherein said scene change detecting information includes said luminance-related information value, and said scene change detecting information and said feature judge value are computed by a processing portion shared on the basis of said luminance-related information value.

18. The image display method according to claim 15, wherein said scene change detecting information includes said feature judge value.

19. The image display method according to claim 15, wherein image quality correction control is performed in a blanking period during a scene change on the basis of said scene change detect value.

20. The image display method according to claim 15, wherein said multiple feature judge value obtained from said luminance signal is used to perform luminance correction, a correction of said image signal, and a control of said display unit.

* * * * *